US007056636B2

(12) United States Patent
Tomita et al.

(10) Patent No.: US 7,056,636 B2
(45) Date of Patent: Jun. 6, 2006

(54) DRY TONER, AND PROCESS CARTRIDGE, IMAGE FORMING PROCESS AND APPARATUS USING THE SAME

(75) Inventors: Masami Tomita, Shizuoka (JP); Fumihiro Sasaki, Shizuoka (JP); Toshiki Nanya, Shizuoka (JP); Hiroto Higuchi, Shizuoka (JP); Shinichiro Yagi, Shizuoka (JP); Shigeru Emoto, Shizuoka (JP); Tomoyuki Ichikawa, Shizuoka (JP); Naohito Shimota, Shizuoka (JP); Maiko Kondo, Shizuoka (JP); Tadao Takikawa, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 185 days.

(21) Appl. No.: 10/712,026

(22) Filed: Nov. 14, 2003

(65) Prior Publication Data

US 2004/0142265 A1 Jul. 22, 2004

(30) Foreign Application Priority Data

Nov. 19, 2002 (JP) ..... 2002-335449
Apr. 3, 2003 (JP) ..... 2003-100049
Aug. 6, 2003 (JP) ..... 2003-287584

(51) Int. Cl.
*G03G 13/20* (2006.01)

(52) U.S. Cl. ..... 430/108.4; 430/108.8; 430/108.1; 430/110.1; 430/110.3; 430/109.4; 399/252

(58) Field of Classification Search ..... 430/108.4, 430/108.8, 108.1, 110.1, 110.3, 109.4; 399/252
See application file for complete search history.

(56) References Cited

U.S. PATENT DOCUMENTS 6,593,048 B1 7/2003 Sasaki et al.
6,597,883 B1 7/2003 Muramatsu et al.
6,653,037 B1 11/2003 Sawada et al.
6,660,443 B1 12/2003 Sugiyama et al.
6,667,141 B1 12/2003 Iwamoto et al.
6,756,175 B1 * 6/2004 Emoto et al. ..... 430/124

FOREIGN PATENT DOCUMENTS

EP 0 594 126 4/1994
EP 0 713 152 5/1996

OTHER PUBLICATIONS

Derwent Publications, AN 2002-247786, XP-002280024, JP 2002-006541, Jan. 9, 2002.
Derwent Publications, AN 2001-508716, XP-002280025, JP 2001-194822, Jul. 19, 2001.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A dry toner contains at least a toner binder, organic fine particles, a colorant, a wax, a charge control agent, and an external additive. The wax is concentrated in the vicinity of a toner core including the toner binder, colorant and wax. The organic fine particles adhere to the surface of the toner core to form a base toner-particle, the fine particle of charge control agent adhere to the surface of the base toner-particle, and the external additive is located on the surface thereof.

25 Claims, 6 Drawing Sheets

DRY TONER, AND PROCESS CARTRIDGE, IMAGE FORMING PROCESS AND APPARATUS USING THE SAME

BACKGROUND OF THE INVENTION

1. Field of the Invention

The present invention relates to a dry toner for a developer, which develops latent electrostatic images in, for example, electrophotography, electrostatic recording, and electrostatic printing. More specifically, it relates to a toner for electrophotography which is used, for example, for copiers, laser printers, facsimiles for plain paper using a direct or indirect electrophotographic developing system. Further, the present invention is directed to a toner for electrophotography which is used for full-color copiers, full-color laser printers, and full-color plain paper facsimile machines using a direct or indirect electrophotographic multicolor developing system.

2. Description of the Related Art

In electrophotography, electrostatic recording and electrostatic printing, a developer is, for example, applied to an latent electrostatic image bearing member such as a photoconductor, so as to dispose the developer onto a latent electrostatic image formed on the latent electrostatic image bearing member in a developing step, the developer disposed on the image is transferred to a recording medium such as a recording paper in a transferring step, thereafter the transferred developer is fixed on the recording medium in a fixing step. Such developers used for developing the latent electrostatic image formed on the latent electrostatic image bearing member generally include two-component developers containing a carrier and a toner, and one-component developers such as magnetic toner and non-magnetic toners, which do not require a carrier.

Conventional dry toners for use in electrophotography, electrostatic recording or electrostatic printing are formed by melting and kneading a toner binder such as a styrenic resin or a polyester, a colorant, and other components, then pulverizing the kneaded substance.

Charging Properties

The toner is generally charged by friction. For example, it is charged as a result of contact friction with a carrier in a two-component developer, and it is charged as a result of contact friction with a feed roller for feeding the toner to a developing sleeve or with a layer thickness controlling blade for uniformizing the toner layer on the developing sleeve. To reproduce latent electrostatic images on an image bearing member such as a photoconductor exactly, charging properties of the toner are important. To yield satisfactory charging properties, a variety of attempts have been made on the types and incorporation processes of a charge control agent into a toner.

Such charge control agents play their roles on the surface of toner particles, and most of them are expensive. Accordingly, attempts have been made to arrange a small amount of a charge control agent on the surface of toner particles. Japanese Patent Application Laid-Open (JP-A) Nos. 63-104064, 05-119513, 09-127720, and 11-327199 disclose techniques in which a charge control agent is applied to the surface of toner particles to impart charging ability to a toner. However, the charging ability of the resulting toner is insufficient, the charge control agent tends to flake off from the surface, and toners having target charging ability cannot be provided even according to the production process disclosed therein. In particular, these patent publications never take an initial charging rate of the toner into consideration.

JP-A No. 63-244056 discloses a method in which a charge control agent is adhered and fixed on the surface of mother toner particles utilizing an impulse force generated at a gap between a rotor (i.e., a blade rotated at a high speed) and a stator (i.e., projections fixed on the inside wall of a vessel). However, since the inside wall has projections, turbulent flows tend to be formed, and thereby the particles may be excessively pulverized or partially melted, the charge control agent may be embedded in the surface of the mother toner particles or adhered to the surface unevenly. This is probably caused by unevenness in energy imparted to the particles. Japanese Patent (JP-B) No. 2962907 describes the relation between the amount of a charge control agent on the surface and that inside of the toner. However, this technique is still insufficient to improve the image-fixing properties of the toner.

Image-Fixing Properties

These dry toners are, after used for developing and transferred on a recording medium such as a sheet of paper, fixed on the sheet by heating and melting the toner using a heat roller. If a temperature of the heat roller is excessively high, in this procedure, "hot offset" occurs. Hot offset is the problem that the toner is excessively melted and adhered onto the heat roller. If a temperature of the heat roller is excessively low, on the other hand, a degree of melting the toner is insufficient, resulted in insufficient image fixing. Accordingly, there are demands in a toner having a higher temperature at which hot offset occurs (excellent hot offset resistance) and a low fixing temperature (excellent image-fixing properties at low temperatures), in view of energy conservation and miniaturization of apparatuses such as copiers. Toners also require a heat-resistant storability that suppresses blocking of toner when the toner is stored, and at a temperature of atmosphere inside the apparatus where the toner is accommodated. Especially, low melting viscosity of toner is essential in full-color copiers and full-color printers in order to yield high gloss and excellent color mixture of an image. As a consequence, polyester toner binders which melts sharply has been used in such a toner. However, this toner tends to cause hot offset. To prevent hot offset, in full-color apparatuses, silicone oil has conventionally been applied on the heat roller. Yet, in the method of applying silicone oil to the heat roller, the apparatuses need to equip an oil tank and an oil applier, therefore the apparatuses become more complex in their structures and large in their size. It also leads a deterioration of the heat roller, so maintenance is required at every certain term. Further, it is unavoidable that the oil is attached to recording media such as copier paper and films for OHP (over head projector), and especially with the films for OHP, the attached oil cases deterioration in color tone.

To prevent a toner fusion without applying an oil to a heat roller, wax is generally added to a toner. In this method, however, releasing effect is largely affected by a condition of dispersed wax within a toner binder. Wax does not exhibit its releasing ability if the wax is compatible with a toner binder. Wax exhibits its releasing ability and improves releasing ability of toner when the wax stays within a toner binder as incompatible domain particles. If a diameter of domain particles is excessively large, the resulting toner may not yield images with good quality. This is because a ratio of wax occurring in a surface portion of a toner with respect to other components of the toner increases with an increasing diameter thereof. The toner particles aggregate to impair fluidity of the toner. Moreover, filming occurs where the wax migrates to a carrier or a photoconductor during long-term use. Color reproducibility and clearness of an image are impaired in the case of color toners. On the contrary, if a diameter of the domain particles is excessively small, the wax is excessively finely dispersed so that sufficient releasing ability cannot be obtained. Although it is necessary to control a diameter of wax as mentioned above, an appropriate method thereof has not been found yet. For example, in the case of toners manufactured by pulverization, control of wax diameter largely relies upon shear force of mixing during melting and kneading procedures. Polyester resins conventionally used for a toner binder have a low viscosity, and sufficient shear force cannot be added thereto. It is very difficult to control distribution of wax and to obtain a suitable diameter especially for these toners. Another problem of pulverization is that more wax is exposed from a surface of toner, since a toner material article tends to broken at portions where the wax occur as a result of pulverization, and such broken portions of the wax constitute surfaces of the toner particles.

Particle Diameter and Shape

Although improvement of toners has been attempted by miniaturize a diameter of toner particle or narrowing particle diameter distribution of toner in order to obtain high quality images, uniform particle shape cannot be obtained by ordinary manufacturing methods of kneading and pulverization. Moreover, the toner is still pulverized so that excessively fine toner particles are generated, in a course of mixing with carrier in a developing member of the apparatus, or, by a contact stress between a development roller, and a toner applying roller, a layer thickness controlling blade, or a friction charging blade. These lead to deterioration of image quality. In addition, a superplasticizer embedded in the surface of toner also leads to deterioration of image quality. Further, fluidity of the toner particles is insufficient because of their shapes, and thus a large amount of the superplasticizer is required or a packing fraction of the toner into a toner vessel becomes low. These factors inhibit miniaturization of apparatuses.

A process for transferring, in which an image formed by a multicolor toner is transferred to a recording medium or a sheet of paper, becomes more and more complicated in order to form full-color images. When toners having non-uniform particle shapes such as pulverized toners are used in such a complicated transferring process, missing portions can be found in the transferred image or an amount of the toner consumption becomes large to cover the missing portions in the transferred image. This is due to the impaired transferring ability caused by non-uniform shapes of the toner particles.

Accordingly, a strong demand has arisen to yield high quality images which do not have any missing part and to reduce running cost by further improving transfer efficiency leading to a reduction in toner consumption. If transfer efficiency is remarkably excellent, a cleaner, which removes remained toner on a photoconductor or a transfer after transferring, can be omitted from an apparatus. Therefore, the apparatus can be miniaturized and low cost thereof can be achieved together with having a merit of reducing a waste toner. Hence, various methods for manufacturing a spherical toner have been suggested in order to overcome the defects caused by a non-uniformly shaped toner.

Conventional Attempts to Solve the Problems

Various investigations have been done to improve properties of toner. For example, a releasing agent (wax) having a low melting point, such as a polyolefin, is added to a toner in order to improve image-fixing properties at low temperatures and offset resistance.

JP-A Nos. 06-295093, 07-84401, and 09-258471 disclose toners that contain a wax having a specific endothermic peak determined by DSC (differential scanning calorimetry). However, the toners disclosed in the above patent publications still need to improve image-fixing properties at low temperatures, offset resistance and also developing properties.

JP-A Nos. 05-341577, 06-123999, 06-230600, 06-295093, and 06-324514 disclose candelilla wax, higher fatty acid wax, higher alcohol wax, vegetable naturally occurring wax (carnauba wax and rice wax), and montan ester wax as a releasing agent of toner. However, the toners disclosed in the above patent publications still need to improve developing properties (charging ability) and durability. If the releasing agent having a low softening point is added to a toner, fluidity of the toner is decreased hence developing properties or transferring ability is also decreased. Moreover, charging ability, durability and storability of the toner may be deteriorated thereby.

JP-A Nos. 11-258934, 11-258935, 04-299357, 04-337737, 06-208244, and 07-281478 disclose toners which contain two or more releasing agents in order to enlarge a fixing region (non offset region). However, the releasing agents are not dispersed sufficiently uniformly in these toners.

JP-A No. 08-166686 discloses a toner which contains polyester resin and two types of offset inhibitors having different acid values and softening points. However, the toner is still insufficient in developing properties.

JP-A Nos. 8-328293, and 10-161335 each disclose a toner that specifies a dispersion diameter of wax within the toner particle. However, the resulting toner may not exhibit sufficient releasing ability during fixing since a condition or positioning of the dispersed wax is not defined in the toner particle.

JP-A No. 2001-305782 discloses a toner in which spherical wax particles are fixed onto the surface of toner. However, the wax particles positioned on the surface of toner decreases fluidity of the toner and thus developing properties or transferring ability of the toner is also decreased. In addition, charging ability, durability, and storability of the toner may also be adversely affected.

JP-A No. 2002-6541 discloses a toner in which wax is included in the toner particle and the wax is located in a surface portion of the toner particle. However, the toner may be insufficient in all of offset resistance, storability, and durability.

Generally, a toner is manufactured by methods of kneading pulverization in which a thermoplastic resin is melted and mixed together with a colorant, and a releasing agent or a charge control agent may be further added according to necessity to form a mixture, and the mixture is pulverized and classified. Further, inorganic or organic fine particles may be added onto the surface of toner particle in order to improve fluidity or cleaning ability. In conventional methods of kneading pulverization, a shape and surface structure of toner particle are not uniform. Although depending on crushability of materials and conditions of pulverizing step, it is not easy to control a shape and surface structure of toner particle arbitrarily. In addition, a particle diameter distribution of a toner cannot be significantly further narrowed, due to limited classifying performance and an increased cost thereby. Regarding a pulverized toner, it is a great task to control an average particle diameter of toner particle to a small particle diameter, especially 6 μm or less, from the viewpoint of yield, productivity and cost.

Objects and Advantages

Accordingly, an object of the present invention is to provide a dry toner, which has improved image-fixing properties at low temperatures and offset resistance with low electric power consumption, forms a high quality toner image, and has an excellent long-term storability.

Another object of the present invention is to provide a dry toner, which has stable charging ability and can always yield a high-quality image with high resolution.

The present inventors has accomplished the present invention based on intensive investigations to develop a dry toner which does not require an application of oil to a heat roller, has excellent image-fixing properties at low temperatures, hot offset resistance, and heat-resistant storability, exhibits stable charging ability and can always form a high-quality image with high resolution. Especially, the investigations have been made for improving a toner which has excellent particle fluidity and transfer ability in the case of a toner having a small particle diameter.

SUMMARY OF THE INVENTION

The present invention provides a dry toner containing at least a toner binder, organic fine particles, a colorant, a wax, a charge control agent, and an external additive, in which the wax is concentrated in the vicinity of a surface of a toner core comprising the toner binder, the colorant and the wax, the organic fine particles are disposed on the surface of the toner core to form a base toner-particle, fine particles of the charge control agent are disposed on the surface of the base toner-particle, and the external additive is disposed on the surface thereof.

The present invention further provides an image forming process including the steps of charging a photoconductor; irradiating the photoconductor with radiation to form a latent electrostatic image thereon; developing the latent electrostatic image using a toner to form a toner image; transferring the toner image onto a recording medium; and fixing the transferred unfixed toner image on the recording medium, in which the fixing step is a heat fixing step of passing the recording medium bearing the unfixed toner image between a film and a pressurizing member of a fixing device, the fixing device including a heating member having a heating element, the film in contact with the heating member, and the pressurizing member in contact with the heating member with the interposition of the film, wherein the toner is the dry toner of the present invention.

The present invention also provides a process cartridge containing at least a photoconductor and a developing device, and being detachable from an image forming apparatus, wherein the developing device contains the dry toner of the present invention.

In addition and advantageously, the present invention provides an image forming apparatus including a photoconductor; a charger for charging the photoconductor; an irradiator for irradiating the photoconductor with radiation to form a latent electrostatic image thereon; a developing unit for developing the latent electrostatic image with a toner to form a toner image; a transferring unit for transferring the toner image onto a recording medium; and a fixer for fixing the transferred toner image on the recording member, wherein the toner is the dry toner of the present invention.

Further objects, features and advantages of the present invention will become apparent from the following description of the preferred embodiments with reference to the attached drawings.

DESCRIPTION OF THE PREFERRED EMBODIMENTS

Figure 1A:
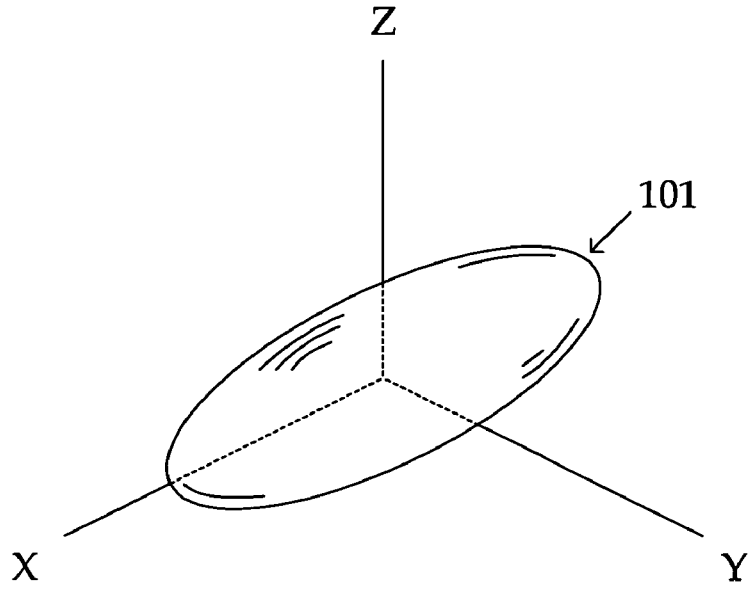
FIGS. 1A, 1B and 1C are a perspective view, a cross sectional view showing a major axis and a minor axis, and a another cross sectional view showing the minor axis and a thickness, of an example of an elliptic toner.

The dry toner of the present invention comprises a toner binder, organic fine particles, a colorant, wax, a charge control agent, and an external additive. In the toner, the wax is concentrated in the vicinity of a surface of a toner core comprising the toner binder, the colorant and the wax, and the organic fine particles adhere to the surface of the toner core to form a base toner-particle. Fine particles of the charge control agent adhere to the surface of the base toner-particle, and the external additive is disposed on the surface of the resulting article. This structure of the toner can achieve the two main objects of the present invention.

The structure of the toner can be verified, for example, in the following manner. Specifically, toner particles are embedded into an epoxy resin and then the epoxy resin is cured. The epoxy resin embedding the toner particles is very finely sliced so as to yield an ultrathin section having a thickness of about 100 μm. The toner particles within the ultrathin section are dyed with ruthenium tetroxide. The ultrathin slice is observed under a transmission electron microscope (TEM) at a magnification of 10,000 times, and pictures of the toner particles are taken. Twenty pictures (twenty toner particles) are visually observed.

In a toner, wax particles should preferably be dispersed stably under appropriate conditions. In the dry toner of the present invention, wax particles are stably dispersed. This is probably because a bonding site of a polar group in the toner binder (specifically in a modified polyester) induces negative adsorption at the interface with the wax to thereby enable the wax having a low polarity to be dispersed stably. The structural configuration of the toner can further prevent exposure of the wax particles from the toner surface, when the toner is prepared by dissolving or dispersing a toner composition in an organic solvent and is then dispersed in an aqueous medium to yield toner particles, although the polar bonding site has a little affinity for water and thereby may migrate toward the surface of the toner selectively.

According to the present invention, wax particles dispersed in the toner selectively locate in the vicinity of the surface of the toner core. More specifically, provided that the vicinity of the surface of the toner core is a region on an arbitrary cross section of the toner core, having the center of the toner core thereon, where the region lies between an outer circumference of the arbitrary cross section and an inner circumference having a radius one half of a radius of the outer circumference, wax particles occurring in the region should preferably occupy 80% by number or more of the total wax particles. Alternatively, provided that the vicinity of the surface of the toner core is a region on an arbitrary cross section of the toner core, having the center of the toner core thereon, where the region lies between an outer circumference of the arbitrary cross section and an inner circumference having a radius two thirds of a radius of the outer circumference, wax particles occurring in the region should preferably occupy 70% by number or more of the total wax particles. Here, the outer circumference is an outer circumference of the toner core. The wax thereby sufficiently bleeds out during fixing, and the toner, even a glossy color toner, can be fixed by "oil-less fixing" which does not require a fixing oil. The toner of the present invention exhibits excellent durability, stability and storability since hardly any wax appears on the surface of the toner particle under a general usage condition.

The aforementioned proportions of wax particles can be determined by calculation by analyzing TEM photographs as above.

It is preferred that the areal ratio of wax particles occurring in a region is from 5% to 40%, which region lies on an arbitrary cross-section having a center of the toner particle thereon and is between the surface of the toner core and 1 μm depth therein. If it is less than 5%, the toner may have insufficient offset resistance. If it exceeds 40%, the toner may have insufficient heat resistance and/or durability.

The distribution of dispersed wax particle diameter in the toner of the present invention is such that 70% by number or more of wax particles have a diameter of 0.1 μm to 3 μm, and preferably such that 70% by number or more of wax particles have a diameter of 1 μm to 2 μm. If a large number of wax particles has a diameter of less than 0.1 μm, the wax may hardly bleed out from the toner particle hence sufficient releasing property cannot be obtained. If a large number of wax particles has a diameter of more than 3 μm, the wax may excessively bleed from the toner particle. Over bleeding of wax leads to aggregation of toner particles, which results in insufficient fluidity, an occurrence of filming, and decreased color reproductively and glossiness in the case of a color toner.

The dispersion of the wax can be controlled by controlling energy of dispersion of the wax in a medium and/or adding an appropriate dispersing agent.

Determination of Location and Number-Average Dispersed Particle Diameter of Wax

In the present invention, a diameter of a dispersed wax particle (number-average dispersed particle diameter) is defined as an average by number of largest diameters of the dispersed wax particles. The diameter of a dispersed wax particle is measures by following method in the present invention. Specifically, toner particles are embedded into an epoxy resin and then the epoxy resin is cured. The epoxy resin embedding the toner particles is very finely sliced so as to yield an ultrathin section having a thickness of approximately 100 μm. The toner particles within the ultrathin section are dyed with ruthenium tetroxide. Thereafter, the ultrathin slice is observed under a transmission electron microscope (TEM) at a magnification of 10,000 times, and pictures of the toner particles are taken. Twenty pictures (twenty toner particles) are visually observed, dispersing conditions of the wax are observed therefrom, and a diameter of the dispersed wax particle is determined.

The wax, which does not position on the surface of the toner particle but position in the surface portion of the toner particle, is defined as follow. Namely, in the above-mentioned pictures, such wax is the dispersed wax particles, which position in a region between an outer circumference of the toner core, i.e., the surface of the toner core, and an inner circumference having one half radius of the outer circumference. When wax particles position on the inner circumference, such wax particles are regarded as positioning in a centric portion of the toner core.

An endothermic peak of the wax measured with a differential scanning calorimeter (DSC) with elevating temperature, is preferably about 65° C. to about 115° C. for good image-fixing at low temperatures. If the endothermic peak of the toner is lower than about 65° C., the toner may have decreased fluidity. If it is higher than about 115° C., the toner may have deteriorated image fixing properties.

The technical effects can be obtained by smoothly bleeding the wax out to the surface of the toner particle. To yield a satisfactory function as a releasing agent, the wax is preferably free fatty acid eliminated carnauba wax, rice wax, montan ester wax or ester wax each having an acid value of 5 KOH-mg/g or less, since wax having a high acid value may have low releasing properties.

By applying organic fine particles to the surface of the base toner-particle, the wax serving as a releasing agent can bleed out only in image fixing procedure. Thus, when the toner is exposed to external force or strain such as stirring in a developing device, deterioration in charging ability of the toner due to wax bleeding from the toner surface can be prevented.

Organic Fine Particles

Resins for use as organic fine particles in the present invention are not specifically limited, as long as they can form a water-based or aqueous dispersion, and can be any of thermoplastic resins and thermosetting resins. Examples of the resins include vinyl resins, polyurethane resins, epoxy resins, polyester resins, polyamide resins, polyimide resins, silicone resins, phenolic resins, melamine resins, urea resins, aniline resins, ionomer resins, and polycarbonate resins. The organic fine particles may comprise two or more types of these resins. Among them, vinyl resins, polyurethane resins, epoxy resins, polyester resins, and mixtures thereof are preferred for yielding an aqueous dispersion of fine spherical resin particles.

Examples of the vinyl resins are homopolymers and copolymers of vinyl monomers, such as styrene-(meth) acrylic ester resins, styrene-butadiene copolymers, (meth) acrylic acid-acrylic ester copolymers, styrene-acrylonitrile copolymers, styrene-maleic anhydride copolymers, and styrene-(meth)acrylic acid copolymers.

By dispersing, into an aqueous medium, a toner composition dissolved or dispersed in an organic solvent, the organic fine particles attach to oil-phase droplets to thereby prevent aggregation of the oil-phase droplets. The oil-phase droplets can have a uniform particle size and can be dispersed stably.

The organic fine particles can be applied to the surface of the base toner-particle by any method not specifically limited. For uniform application, fine resin particles having a small particle diameter are applied to the surface of the base toner-particle and are then heated and fused. Alternatively, the base toner-particle is dipped in a liquid containing the organic fine particles.

Fine particles of the charge control agent are applied and fixed onto the surface of the resulting toner core. Thus, the toner particles can be charged more uniformly and stably than those in which the charge control agent is dispersed inside the toner cores. The fine particles of the charge control agent can be applied by any method not specifically limited. For uniform application, fine particles of the charge control agent having a small particle diameter are applied to the toner core surface and are stirred under application of high energy. Alternatively, the fine particles are applied to the toner core surface in a liquid.

Charge Control Agent

Charge control agents for use in the toner of the present invention include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), BONTRON X-11, and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the toner binder, additives, if any, used according to necessity, and the method for preparing the toner including a dispersing process and is preferably from 0.1 parts by weight to 10 parts by weight, and more preferably from 2 parts by weight to 5 parts by weight, relative to 100 parts by weight of the binder resin. When the charge control agent is applied to the surface of the toner core, its amount is preferably from 0.1 parts by weight to 5 parts by weight, and more preferably from 0.2 parts by weight to 3 parts by weight relative to 100 parts by weight of the toner matrix. If the amount exceeds 5 parts by weight, the toner may have excessively high charging ability, thus inviting decreased fluidity of the developer or decreased density of images.

Toner Binder

Preferred toner binders for use in the present invention are modified polyesters.

The term "modified polyester" for use herein means and includes a polyester resin having another bonding group than ester bonds or comprising a resin component having a different composition combined, for example, through a covalent bond or an ionic bond. More specifically, the modified polyester means and includes a polyester having a modified polyester terminal prepared by introducing a functional group such as isocyanate group that can react with a carboxyl group and/or a hydroxyl group and allowing the resulting substance to react with an active-hydrogen-containing compound.

Examples of the modified polyester (i) are urea-modified polyesters obtained as a result of the reaction between a polyester prepolymer (A) having an isocyanate group and an amine (B). The polyester prepolymer (A) having an isocyanate group can be one prepared, for example, by allowing a polyester being as a polycondensate between a polyol (1) and a polycarboxylic acid (2) and having an active hydrogen group to react with a polyisocyanate (3). The active hydrogen group of the polyester includes, for example, hydroxyl groups (alcoholic hydroxyl groups and phenolic hydroxyl groups), amino groups, carboxyl groups, and mercapto groups, of which alcoholic hydroxyl groups are preferred.

Examples of the polyol (1) include diols (1-1) and trihydric or higher polyols (1-2). As the polyol (1), a diol (1-1) alone or a mixture of a diol (1-1) and a small amount of a polyol (1-2) is preferred.

Examples of the diols (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexanedimethanol, and hydrogenated bisphenol A; bisphenols such as bisphenol A, bisphenol F, and bisphenol S; alkylene oxide (e.g., ethylene oxide, propylene oxide, and butylene oxide) adducts of the aforementioned alicyclic diols; and alkylene oxide (e.g., ethylene oxide, propylene oxide, and butylene oxide) adducts of the aforementioned bisphenols. Among them, alkylene glycols each having 2 to 12 carbon atoms, and alkylene oxide adducts of bisphenols are preferred, of which alkylene oxide adducts of bisphenols alone or in combination with any of alkylene glycols having 2 to 12 carbon atoms are typically preferred.

The trihydric or higher polyols (1-2) include, for example, trihydric or higher aliphatic alcohols such as glycerol, trimethylolethane, trimethylolpropane, pentaerythritol, and sorbitol; trihydric or higher phenols such as trisphenol PA, phenol novolacs, and cresol novolacs; and alkylene oxide adducts of these trihydric or higher polyphenols.

The polycarboxylic acid (2) includes, for example, dicarboxylic acids (2-1) and tri- or higher polycarboxylic acids (2-2). As the polycarboxylic acid (2), a dicarboxylic acid (2-1) alone or in combination with a small amount of a tri- or higher polycarboxylic acid (2-2) is preferred. The dicarboxylic acids (2-1) include, but are not limited to, alkylenedicarboxylic acids such as succinic acid, adipic acid, and sebacic acid; alkenylenedicarboxylic acids such as maleic acid, and fumaric acid; aromatic dicarboxylic acids such as phthalic acid, isophthalic acid, terephthalic acid, and naphthalenedicarboxylic acid. Among them, preferred are alkenylenedicarboxylic acids each having 4 to 20 carbon atoms and aromatic dicarboxylic acids each having 8 to 20 carbon atoms. The tri- or higher polycarboxylic acids (2-2) include, for example, aromatic polycarboxylic acids each having 9 to 20 carbon atoms, such as trimellitic acid and pyromellitic acid. An acid anhydride or lower alkyl ester (e.g., methyl ester, ethyl ester, and propyl ester) of any of the polycarboxylic acids can be used as the polycarboxylic acid (2) to react with the polyol (1).

The ratio of the polyol (1) to the polycarboxylic acid (2) in terms of the equivalence ratio [OH]/[COOH] of the hydroxyl groups [OH] to the carboxyl groups [COOH] is generally from 2/1 to 1/1, preferably from 1.5/1 to 1/1, and more preferably from 1.3/1 to 1.02/1.

The polyisocyanate (3) includes, but is not limited to, aliphatic polyisocyanates such as tetramethylene diisocyanate, hexamethylene diisocyanate, and 2,6-diisocyanatomethyl caproate; alicyclic polyisocyanates such as isophorone diisocyanate, and cyclohexylmethane diisocyanate; aromatic diisocyanates such as tolylene diisocyanate, and diphenylmethane diisocyanate; aromatic-aliphatic diisocyanates such as α,α,α',α'-tetramethylxylylene diisocyanate; isocyanurates; blocked products of the polyisocyanates with, for example, phenol derivatives, oximes, or caprolactams; and mixtures of these compounds.

The amount of the polyisocyanate (3) in terms of the equivalence ratio [NCO]/[OH] of isocyanate groups [NCO] to hydroxyl groups [OH] of the polyester is generally from 5/1 to 1/1, preferably from 4/1 to 1.2/1, and more preferably from 2.5/1 to 1.5/1.

If the ratio [NCO]/[OH] is more than 5, image-fixing properties at low temperatures may deteriorate. If the ratio [NCO/[OH] is less than 1, a urea content in the modified polyester decreases, and the toner may have deteriorated hot offset resistance. The content of the polyisocyanate (3) in the prepolymer (A) having an isocyanate group is generally from 0.5% by weight to 40% by weight, preferably from 1% by weight to 30% by weight, and more preferably from 2% by weight to 20% by weight. If the content is less than 0.5% by weight, the hot off-set resistance may deteriorate, and satisfactory storage stability at high temperatures and image-fixing properties at low temperatures may not be obtained concurrently. If the content is more than 40% by weight, the image-fixing properties at low temperatures may deteriorate.

The prepolymer (A) generally has, in average, 1 or more, preferably 1.5 to 3, and more preferably 1.8 to 2.5 isocyanate groups per molecule.

If the number of the isocyanate group per molecule is less than 1, the urea-modified polyester may have a low molecular weight and the hot off-set resistance may deteriorate.

The amine (B) includes, for example, diamines (B1), tri- or higher polyamines (B2), amine alcohols (B3), aminomercaptans (B4), amino acids (B5), and amino-blocked products (B6) of the amines (B1) to (B5).

The diamines (B1) include, but are not limited to, aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexanes, and isophoronediamine; and aliphatic diamines such as ethylenediamine, tetramethylenediamine, and hexamethylenediamine.

The tri- or higher polyamines (B2) include, for example, diethylenetriamine, and triethylenetetramine.

The amino alcohols (B3) include, but are not limited to, ethanolamine, and hydroxyethylaniline.

The aminomercaptans (B4) include, for example, aminoethyl mercaptan, and aminopropyl mercaptan.

The amino acids (B5) include, but are not limited to, aminopropionic acid, and aminocaproic acid.

The amino-blocked products (B6) of the amines (B1) to (B5) includes ketimine compounds and oxazoline compounds derived from the amines (B1) to (B5) and ketones such as acetone, methyl ethyl ketone, and methyl isobutyl ketone. Among these amines (B), preferred are the diamine (B1) alone or in combination with a small amount of the polyamine (B2).

Where necessary, the molecular weight of the modified polyester can be controlled by using an elongation terminator. Such elongation terminators include, but are not limited to, monoamines such as diethylamine, dibutylamine, butylamine, and laurylamine; and blocked products (ketimine compounds) of these monoamines.

The content of the amine (B) in terms of the equivalence ratio [NCO]/[NHx] of isocyanate groups [NCO] in the prepolymer (A) to amino groups [NHx] of the amine (B) is generally from 1/2 to 2/1, preferably from 1/1.5 to 1.5/1 and more preferably from 1.2/1 to 1/1.2.

If the ratio [NCO]/[NHx] exceeds 2/1 or is less than 1/2, the urea-modified polyester (i) may have a low molecular weight, and the hot off-set resistance may deteriorate. The urea-modified polyester (i) may further comprise urethane bonds in addition to urea bonds. The molar ratio of the urea bond to the urethane bond is generally from 100/0 to 10/90, preferably from 80/20 to 20/80, and more preferably from 60/40 to 30/70. If the molar ratio of the urea bond to the urethane bond is less than 10/90, the hot off-set resistance may deteriorate.

The modified polyester (i) for use in the present invention can be prepared, for example, by a one-shot method or a prepolymer method. The weight-average molecular weight of the modified polyester (i) is generally 10,000 or more, preferably from 20,000 to 10,000,000, and more preferably from 30,000 to 1,000,000. The peak molecular weight herein is preferably from 1,000 to 10,000. If the peak molecular weight is less than 1,000, the modified polyester is resistant to an elongation reaction, and the resulting toner may have decreased elasticity and thereby have deteriorated hot off-set resistance. If it exceeds 10,000, the image-fixing properties may deteriorate, and granulation or pulverization procedure in its production may become difficult. The term "peak molecular weight" as used herein means a molecular weight at which a peak is observed in GPC analysis. The number-average molecular weight of the modified polyester (i) is not specifically limited when an unmodified polyester (ii) mentioned later is used in combination and may be such a number-average molecular weight as to yield the above-specified weight-average molecular weight. If the modified polyester (i) is used alone, the number-average molecular weight thereof is generally 20,000 or less, preferably from 1,000 to 10,000, and more preferably from 2,000 to 8,000. If the number-average molecular weight is more than 20,000, the image-fixing properties at low temperatures and glossiness upon use in a full-color apparatus may deteriorate.

In the present invention, the modified polyester (i) can be used alone or in combination with an unmodified polyester (ii) as the toner binder component of the toner. The combination use of the modified polyester (i) with the unmodified polyester (ii) may improve the image-fixing properties at low temperatures and glossiness upon use in a full-color apparatus and is more preferred than the use of the modified polyester (i) alone. Examples and preferred examples of the unmodified polyester (ii) are polycondensation products of a polyol (1) and a polycarboxylic acid (2) as in the polyester components of the modified polyester (i). The unmodified polyesters (ii) include unmodified polyesters as well as polyesters modified with a urethane bond and other chemical bonds except urea bonds. The modified polyester (i) and the unmodified polyester (ii) are preferably at least partially compatible or miscible with each other for better image-fixing properties at low temperatures and hot offset resistance. Accordingly, the polyester components of the modified polyester (i) and the unmodified polyester (ii) preferably have similar compositions to each other. The weight ratio of the modified polyester (i) to the unmodified polyester (ii), if any, is generally from 5/95 to 80/20, preferably from 5/95 to 30/70, more preferably from 5/95 to 25/75, and typically preferably from 7/93 to 20/80. If the weight ratio is less than 5/95, the hot offset resistance may deteriorate, and satisfactory storage stability at high temperatures and image fixing properties at low temperatures may not be obtained concurrently.

The peak molecular weight of the unmodified polyester (ii) is generally from 1,000 to 10,000, preferably from 2,000 to 8,000, and more preferably from 2,000 to 5,000. If the peak molecular weight is less than 1,000, the storage stability at high temperatures may deteriorate, and if it is more than 10,000, the image-fixing properties at low temperatures may deteriorate. The hydroxyl value of the unmodified polyester (ii) is preferably 5 or more, more preferably from 10 to 120, and typically preferably from 20 to 80. If the hydroxyl value is less than 5, satisfactory storage stability at high temperatures and image-fixing properties at low temperatures may not be obtained concurrently. The acid value of the unmodified polyester (ii) is generally from 1 to 5, and preferably from 2 to 4. A wax having a high acid value is used as the wax, and therefore a binder having a low acid value is preferred as the binder for use in a two-component toner, since such a binder having a low acid value can yield satisfactory charges and high volume resistance.

In the present invention, the glass transition point Tg of the toner binder is generally from 40° C. to 70° C., and preferably from 55° C. to 65° C. If the glass transition point is lower than 40° C., the storage stability at high temperatures of the toner may deteriorate, and if it is more than 70° C., the image-fixing properties at low temperatures may be insufficient. By using the urea-modified polyester, the toner of the present invention, even with a low glass transition point, shows more satisfactory heat-resistant storability than conventional polyester toners.

Colorants

Any conventional or known dyes and pigments can be used as the colorant of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. The content of the colorant is generally from 1% by weight to 15% by weight, and preferably from 3% by weight to 10% by weight of the toner.

A colorant for use in the present invention may be a master batch prepared by mixing and kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly (methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

External Additive

Inorganic fine particles can be preferably used as the external additive to improve or enhance the fluidity, developing properties, and charging ability of the toner particles. Among them, hydrophobic silica and/or hydrophobic titanium oxide is typically preferred. The inorganic fine particles have a primary particle diameter of preferably from 5 nm to 2 μm, and more preferably from 5 nm to 500 nm and have a specific surface area as determined by the BET method of preferably from 20 $m^2/g$ to 500 $m^2/g$. The amount of the inorganic fine particles is preferably from 0.01% by weight to 5% by weight, and more preferably from 0.01% by weight to 2.0% by weight of the toner.

Examples of other inorganic fine particles than hydrophobic silica and hydrophobic titanium oxide are alumina, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are polymer particles such as polystyrene, copolymers of methacrylic esters or acrylic esters prepared by soap-free emulsion polymerization, suspension polymerization or dispersion polymerization; silicone resins, benzoguanamine resins, nylon resins, and other polycondensed or thermosetting resins.

A surface treatment is suitably performed on these external additives to improve hydrophobic property so that fluidity and charging ability are inhibited from being impaired even in a high humidity atmosphere. Suitable surface treatment agents are, for example, a silane coupling agent, a sililating agent, a silane coupling agent having a fluorinated alkyl group, an organic titanate coupling agent, an aluminium coupling agent, a silicone oil, and a modified silicone oil.

A cleaning agent (cleaning improver) may also be added in order to remove the developer remained on a photoconductor or on a primary transfer member after transfer. Suitable cleaning agents are, for example, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Such fine polymer particles preferably have a relatively narrow particle distribution and a volume-average particle diameter of 0.01 μm to 1 μm.

Production Methods

The toner binder can be produced, for example, by the following method. A polyol (1) and a polycarboxylic acid (2) are heated at 150° C. to 280° C. in the presence of a known esterification catalyst such as tetrabutyl titanate or dibutyltin oxide, and produced water is removed by distillation where necessary under a reduced pressure to thereby yield a polyester having a hydroxyl group. The polyester is allowed to react with a polyisocyanate (3) at 40° C. to 140° C. and thereby yields a prepolymer (A) having an isocyanate group. The prepolymer (A) is allowed to react with an amine (B) at 0° C. to 140° C. and thereby yields a polyester (i) modified with a urea bond. In the reactions between the polyester and the polyisocyanate (3) and between the prepolymer (A) and the amine (B), solvents can be used according to necessity. Such solvents for use herein include, for example, aromatic solvents such as toluene and xylene; ketones such as acetone, methyl ethyl ketone, and methyl isobutyl ketone; esters such as ethyl acetate; amides such as dimethylformamide and dimethylacetamide; and ethers such as tetrahydrofuran, and other solvents inert to the isocyanate (3). When the unmodified polyester(ii) is used in combination with the urea-modified polyester (i), the unmodified polyester (ii) is prepared in the same manner as in the polyester having a hydroxyl group, and then the unmodified polyester (ii) is dissolved and mixed into the solution after the completion of the reaction of the urea-modified polyester (i).

The dry toner of the present invention can be prepared, for example, by the following method.

Toner Production in Aqueous Medium

A toner composition containing a modified polyester or polyester prepolymer is dissolved or dispersed in an organic solvent, and the resulting solution or dispersion is dispersed in an aqueous medium to yield toner core particles.

Preferred organic solvents for use herein are those having a boiling point of lower than 150° C. and thus being volatile for high removability. Such solvents include, but are not limited to, toluene, xylenes, benzene, carbon tetrachloride, methylene chloride, 1,2-dichloroethane, 1,1,2-trichloroethane, trichloroethylenes, chloroform, monochlorobenzene, dichloroethylidene, methyl acetate, ethyl acetate, methyl ethyl ketone, and methyl isobutyl ketone. Each of these solvents can be used alone or in combination.

Aqueous media for use herein may comprise water alone or in combination with an organic solvent that is miscible with water. Such miscible organic solvents include, but are not limited to, alcohols such as methanol, isopropyl alcohol, and ethylene glycol; dimethylformamide; tetrahydrofuran; Cellosorves such as methyl cellosolve; and lower ketones such as acetone and methyl ethyl ketone.

Particles of the toner core are prepared by dissolving or dispersing materials for the toner core other than the organic fine particles in an organic solvent, and dispersing the solution or dispersion into an aqueous medium containing the organic fine particles. Thus, oil-phase droplets of the dispersion of the materials for the toner core in the solvent are formed, and the organic fine particles then cover the oil-phase droplets. When a large amount of the organic fine particles is used, the organic fine particles more effectively cover the surface of the droplets, and the resulting droplets have a small size. The urea-modified polyester (i) may be formed in this procedure by allowing a dispersion containing the prepolymer (A) having isocyanate groups to react with the amine (B). Alternatively, the urea-modified polyester (i) may be prepared previously. To form a dispersion comprising the urea-modified polyester (i) or prepolymer (A) stably, the toner composition containing the urea-modified polyester (i) or the prepolymer (A) is dispersed in an aqueous medium under shearing force. It is preferred that the other toner materials such as the colorant and wax are added during the formation of the toner core particles in the aqueous medium and that the charge control agent is added after the formation of the toner core particles.

The dispersing procedure is not specifically limited and includes known procedures such as low-speed shearing, high-speed shearing, dispersing by friction, high-pressure jetting, and ultrasonic dispersion. To allow the dispersed particles to have an average particle diameter of 2 μm to 20 μm, the high-speed shearing procedure is preferred. When a high-speed shearing dispersing machine is used, the number of rotation is not specifically limited and is generally from 1,000 rpm to 30,000 rpm and preferably from 5,000 rpm to 20,000 rpm. The dispersion time is not specifically limited and is generally from 0.1 to 5 minutes in a batch system. The dispersing temperature is generally from 0° C. to 150° C. under a pressure (under a load) and preferably from 40° C. to 98° C. A high dispersing temperature is preferred, since the dispersion comprising the urea-modified polyester (i) or the prepolymer (A) has a low viscosity and can be dispersed more easily.

The amount of the aqueous medium is generally from 50 parts by weight to 2,000 parts by weight, and preferably from 100 parts by weight to 1,000 parts by weight, with respect to 100 parts by weight of the toner composition containing the urea-modified polyester (i) or the prepolymer (A). If the amount is less than 50 parts by weight, the toner composition may not be dispersed sufficiently, and the resulting toner particles may not have a target particle diameter. If it is more than 2,000 parts by weight, it is not economical. Preferably, a dispersing agent is used in the dispersing procedure for sharper particle distribution and more stable dispersion of the toner particles.

Examples of such dispersing agents for emulsifying and dispersing the oil phase containing the dispersed toner composition in an aqueous medium are alkylbenzene sulfonates, α-olefin sulfonates, phosphoric esters, and other anionic surfactants; alkylamine salts, amino alcohol fatty acid derivatives, polyamine fatty acid derivatives, imidazoline, and other amine salts cationic surfactants, alkyltrimethylammonium salts, dialkyldimethylammonium salts, alkyldimethylbenzylammonium salts, pyridinium salts, alkylisoquinolinum salts, benzethonium chloride, other quaternary ammonium salts cationic surfactants, and other cationic surfactants; fatty acid amide derivatives, polyhydric alcohol derivatives, and other nonionic surfactants; alanine, dodecyl di(aminoethyl) glycine, di(octylaminoethyl) glycine, N-alkyl-N,N-dimethylammonium betaines, and other amphoteric surfactants.

The effects of the surfactants can be obtained in a small amount by using a surfactant having a fluoroalkyl group. Preferred examples of fluoroalkyl-containing anionic surfactants are fluoroalkylcarboxylic acids each containing 2 to 10 carbon atoms, and metallic salts thereof, disodium perfluorooctanesulfonyl glutamate, sodium 3-[omega-fluoroalkyl ($C_6$-$C_{11}$) oxy]-1-alkyl ($C_3$-$C_4$) sulfonate, sodium 3-[omega-fluoroalkanoyl ($C_6$-$C_8$)-N-ethylamino]-1-propanesulfonate, fluoroalkyl ($C_{11}$-$C_{20}$) carboxylic acids and metallic salts thereof, perfluoroalkyl carboxylic acids ($C_7$-$C_{13}$) and metallic salts thereof, perfluoroalkyl ($C_4$-$C_{12}$) sulfonic acids and metallic salts thereof, perfluorooctanesulfonic acid diethanolamide, N-propyl-N-(2-hydroxyethyl) perfluorooctanesulfonamide, perfluoroalkyl ($C_6$-$C_{10}$) sulfonamide propyl trimethyl ammonium salts, perfluoroalkyl ($C_6$-$C_{10}$)-N-ethylsulfonyl glycine salts, and monoperfluoroaklyl ($C_6$-$C_{16}$) ethyl phosphoric esters.

Such fluoroalkyl-containing anionic surfactants are commercially available under the trade names of, for example, SURFLON S-111, S-112 and S-113 (from Asahi Glass Co., Ltd.), FLUORAD FC-93, FC-95, FC-98 and FC-129 (from Sumitomo 3M Limited), UNIDYNE DS-101 and DS-102 (from Daikin Industries, Ltd.), MEGAFAC F-110, F-120, F-113, F-191, F-812 and F-833 (from Dainippon Ink & Chemicals, Incorporated), EFTOP EF-102, 103, 104, 105, 112, 123A, 123B, 306A, 501, 201 and 204 (from JEMCO Inc.), and FTERGENT F-100 and F-150 (from Neos Co., Ltd.).

Examples of fluoroalkyl-containing cationic surfactants for use in the present invention include aliphatic primary, secondary and tertiary amic acids each having a fluoroalkyl group; aliphatic quaternary ammonium salts such as perfluoroalkyl ($C_6$-$C_{10}$) sulfonamide propyltrimethylammonium salts; benzalkonium salts; benzethonium chloride; pyridinium salts; and imidazolinium salts. Such fluoroalkyl-containing cationic surfactants are commercially available, for example, under the trade names of SURFLON S-121 (from Asahi Glass Co., LTD.), FLUORAD FC-135 (from Sumitomo 3M Limited), UNIDYNE DS-202 (from Daikin Industries, LTD.), MEGAFAC F-150, and F-824 (from Dainippon Ink & Chemicals, Incorporated), EFTOP EF-132 (from JEMCO Inc.), and FTERGENT F-300 (from Neos Co., Ltd.).

In addition, water-insoluble inorganic compounds such as tricalcium phosphate, calcium carbonate, titanium oxide, colloidal silica, and hydroxyapatite can be also used as the dispersing agent.

For further stabilizing the primary particles in the dispersion, a polymeric protective colloid can be used. Examples of the polymeric protective colloid include homopolymers and copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound, such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; nitrogen atom such as vinylpyridine, vinylpyrrolidone, vinylimidazole, and ethyleneimine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

When calcium phosphate or another dispersion stabilizer that is soluble in acids or bases is used, the dispersion stabilizer is removed from the fine particles by dissolving the dispersion stabilizer by action of an acid such as hydrochloric acid and washing the fine particles. Alternatively, the component can be removed, for example, by enzymatic decomposition.

The dispersing agent, if used, is preferably removed by washing after elongation and/or crosslinking reaction for better charging properties of the toner, although it is also acceptable that the dispersing agent remains on the surface of toner particles.

To decrease the viscosity of the toner composition and to increase the sharpness of the particle distribution, a solvent that can solve the urea-modified polyester (i) and/or the prepolymer (A) is preferably used. Such solvents for use herein are preferably volatile and have a boiling point of lower than 100° C. for easier removal from toner particles. Such solvents include, but are not limited to, toluene, xylenes, benzene, carbon tetrachloride, methylene chloride, 1,2-dichloroethane, 1,1,2-trichloroethane, trichloroethylenes, chloroform, monochlorobenzene, dichloroethylidene, methyl acetate, ethyl acetate, methyl ethyl ketone, and methyl isobutyl ketone. Each of these solvents can be used alone or in combination. Among them, preferred solvents are toluene, xylenes, and other aromatic solvents, methylene chloride, 1,2-dichloroethane, chloroform, carbon tetrachloride, and other halogenated hydrocarbons.

The amount of the solvent is generally from 0 to 300 parts by weight, preferably from 0 to 100 parts by weight, and more preferably from 25 to 70 parts by weight, relative to 100 parts by weight of the polyester prepolymer (A). The solvent, if used, is removed by heating at normal atmospheric pressure or under a reduced pressure after the elongation and/or crosslinking reaction.

The reaction time for elongation and/or crosslinking is appropriately set depending on the reactivity derived from the combination of the isocyanate structure of the polyester prepolymer (A) and the amine (B) and is generally from 10 minutes to 40 hours and preferably from 2 to 24 hours. The reaction temperature is generally from 0° C. to 150° C. and preferably from 40° C. to 98° C. Where necessary, a known catalyst such as dibutyltin laurate and dioctyltin laurate can be used.

In order to remove the organic solvent from the obtained emulsified dispersion, the whole part thereof can be gradually heated so as to completely evaporate the organic solvent. The organic solvent can also be removed by spraying the emulsified dispersion into a dry atmosphere to completely remove a water-insoluble organic solvent in the droplets of the emulsified dispersion to form fine toner particles. In this case, the aqueous dispersing agent can also be evaporated and removed together with the organic solvent. Examples of the dry atmosphere are heated gases such as air, nitrogen, carbon dioxide, and combustion gas. Especially, it is preferable to use stream of the above-mentioned gases which is heated at higher temperature than the highest boiling point of the used solvents. A target quality is efficiently attained with a high-speed treatment using, for example, a spray dryer, belt dryer or rotary kiln.

If the particle diameter distribution is wide at the time of emulsification and dispersion and also at the time of washing and drying, the particles are classified so as to attain the target particle diameter distribution.

The classification of particles can be carried out in the solution using a device such as a cyclone, decanter or centrifuge so as to attain the predetermined particle diameter distribution. Although the classification can be carried out on dried particles after drying, it is more preferred that the classification is carried out in a solution, from the viewpoint of efficiency of the process. The obtained irregular toner particles and coarse particles, as a result of the classification, are sent back to the kneading step so as to recycle. In this case, the fine particles or coarse particles may be in a wet condition.

The dispersing agent is preferably removed from the obtained dispersion, and more preferably removed at the same time of the classification.

The dried particles of the toner core are mixed with other particles such as fine particles of the charge control agent and fine particles of the external additive. Thereafter, mechanical impact force is applied to the mixed particles so as to fix or fuse the particles on the surface of the toner particle. In this way, the obtained complex toner particle can prevent falling of other particles therefrom.

Specific methods for applying an impact force are, for example, a method in which the impact force is applied to the mixed particles by using a rotated impeller blade in high speed, a method in which the mixed particles are placed in high-speed flow so as to subject the mixed particles or complex particles to be in a collision course with a suitable collision board. Examples of apparatus therefor include angmill (available from Hosokawa Micron Corporation), a modified I-type mill (available from Nippon Pneumatic MFG., Co., Ltd.) which is reduced pulverizing air pressure, a hybridization system (available from Nara Machine Corporation), Kryptron System (available from Kawasaki Heavy Industries, Ltd.), and an automatic mortar.

Particle Diameter Distribution

The volume-average particle diameter Dv of the toner of the present invention is about 3 μm to about 8 μm, and the ratio (Dv/Dn) of the volume-average particle diameter Dv to a number-average particle diameter Dn to is about 1.00 to about 1.20. It is preferred that the volume-average particle diameter Dv is 3 μm to 6 μm and the ratio (Dv/Dn) is 1.00 to 1.15, from the viewpoints of excellent heat-resistant storability, image-fixing properties at low temperatures, and hot offset resistance. By satisfying the above-mentioned preferred ranges, especially glossiness of an image becomes excellent when the toner is used in a full-color copier. Further, when the toner is used in a double-component developer, variation of the toner particle diameter is minimized even after repeating cycles of consumption and addition of the toner with respect to carrier. As the toner keeps a narrow average particle diameter without being affected by stirring in a developing device for a long period, the toner can keep stable and excellent developing properties. When the toner is used as a single-component developer, the variation of the toner particle diameter is minimized as in the double-component developer. In addition, filming of the toner to a development roller, and toner fusion of members such as toner blade which controls the toner thickness on the development roller are also prevented. Hence, even if the toner is used (stirred) in the image developer for a long period of time, the toner can keep stable and excellent developing properties to form high-quality images stably.

It is generally believed that the smaller a toner diameter can obtain the higher an image resolution and image quality. However, the toner having a smaller diameter may be insufficient in transferring ability and cleaning ability. When a volume-average particle diameter of the toner is smaller than the range specified in the present invention, the toner as a double-component developer tend to fuse onto a surface of carrier by being stirred in the image developing device for a long period of time and thus charging ability of the carrier is impaired. In addition, in the case of a single-component developer, filming of the toner to a development roller, and toner fusion to members such as a blade which control the toner thickness on a development roller tend to occur.

Theses tendencies are largely related to a content of fine particles. If a toner contains toner particles having a diameter of 3 μn or less in an amount more than 10% by number relative to the total number thereof on the cross-section, the toner is more likely to fuse onto the carrier. Therefore, problems occur when stability of charge is highly required.

When a volume-average particle diameter of toner is larger than the range specified in the present invention, high-quality images with high resolution may not be obtained. In addition, variation of the toner particle diameter becomes large since the toner is repeatedly consumed and supplied to adjust the toner amount with respect to the carrier in the developing device during developing. If the ratio Dv/Dn exceeds 1.20, the toner may have a decreased resolution. Moreover, when the toner particles have a diameter less than 3 μm, the toner particles may be floated in the air and may harm human bodies. When the toner particles have a diameter exceeding 8 μm, sharpness of toner image on a photoconductor may be decreased with a decreased image resolution.

Generally, an average particle diameter, and a particle distribution of a toner are measured by a Coulter counter method. The Coulter counter method can be carried out with, for example, Coulter Counter TA-II, Coulter Multisizer II (trade names, available from Beckman Coulter, Inc.). In the present invention, an average particle diameter and a particle diameter distribution of a toner are determined by using the Coulter Counter TA-II connected with a personal computer PC 9801 (trade name, available from NEC Corporation) in which Inter Face (trade name, available from Institute of Japanese Union of Scientists & Engineers) is installed. Inter Face is a software capable of analyzing and outputting number distribution and volume distribution of a toner.

Circularity

The circularity of the dry toner is preferably determined by an optical detection band method, wherein the particle-containing suspension is allowed to pass through a photographic detection band on a plate, and the particle images were optically detected/analyzed with a CCD camera. The average circularity obtained by dividing a boundary length of a corresponding circle having an equal projected area by a boundary length of the measured particle. The present inventors have found that a toner having an average circularity of 0.93 or more is effective to form images with an appropriate density and high precision and reproducibility. The average circularity is more preferably from 0.980 to 1.000.

It is very important for the toner of the present invention to have a certain shape and a certain distribution of the shape. When an average circularity of the toner is less than about 0.93, namely the irregularly shaped toner being far from a round shape, sufficient transfer ability, high quality images without scattering of the toner may not be obtained. The irregularly shaped toner has higher attraction forces such as van der Waals force and image force, to a smooth medium such as a photoconductor than relatively spherical particles because this toner has more concave portions constituting contact points to the medium, and charges concentrate and stay in the concave portions. In electrostatic transferring step, therefore, irregularly formed toner particles are selectively transferred within the toner which contains irregularly formed toner particles and spherical toner particles, resulting in an image missing on character or line portions. The remained toner on the medium has to be removed for a subsequent developing step, a cleaner needs to be equipped therefor, and a toner yield (a usage ratio of the toner for image formation) is low. A circularity of pulverized toner is generally 0.910 to 0.920.

The circularity of the dry toner of the present invention is measured with a flow-type particle image analyzer FPIA-2000 (available from Sysmex Corporation).

Elliptic Toner

The toner of the present invention may have an spindle shape.

When the shape of a toner is irregular or compressed and the toner has poor particle fluidity because of its shape, following problems occur. The toner deposits on the background of images, as a result of insufficient friction charge. It is difficult for such badly shaped toner to precisely and uniformly be placed on very fine latent dot images at developing step. Therefore, such toner generally has poor dot reproducibility. Further, the toner has insufficient transfer efficiency in latent electrostatic transferring system since the irregularly shaped toner is hard to receive electric line of force.

The toner having an spindle shape has an appropriately controlled fluidity, can be charged by friction smoothly and thereby avoids toner deposition on the background of images. The toner image can be precisely developed in exact accordance with fine latent dot images and can be efficiently transferred to, for example, a recording medium, thus exhibiting excellent dot reproducibility. The appropriate fluidity of the toner can also prevent scattering of the toner particles during these procedures. In addition, the elliptic toner is more resistant to cleaning failures than a spherical toner, since the spherical toner is easily rolled out into the space between a photoconductor and a cleaning member.

Figure 1B:
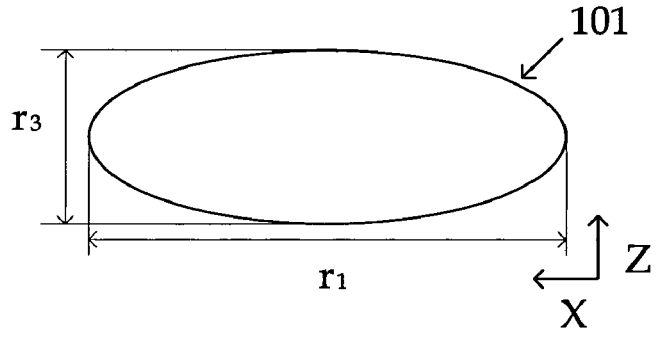
Figure 1C:
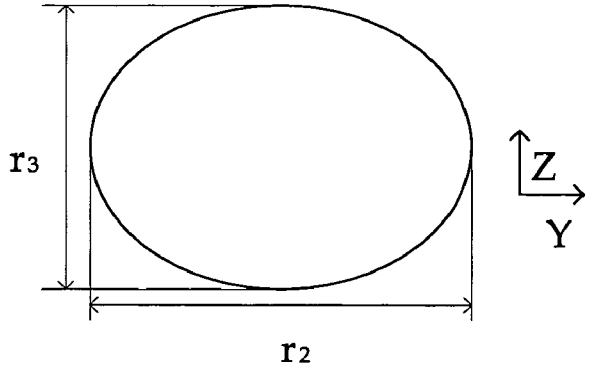

An example of the toner having an spindle shape is shown in FIGS. 1A, 1B, and 1C. The elliptic toner 101 is preferably in an spindle shape having a major axis r1, a minor axis r2, and a thickness r3, in which the ratio (r2/r1) of the minor axis to the major axis r1 is about 0.5 to about 0.8 (FIG. 1B), and the ratio (r3/r2) of a thickness r3 to the minor axis r2 is about 0.7 to about 1.0 (FIG. 1C). If the ratio (r2/r1) is less than about 0.5, a cleaning property of the toner is high because of less spherical toner particle shape. However, it is insufficient in dot reproducibility and transfer efficiency hence high quality images may not be obtained.

If the ratio (r2/r1) exceeds about 0.8, cleaning failures may occur specially in an atmosphere of low temperatures and low humidity since the toner particle shape become closer to sphere.

Especially when the ratio (r3/r2) is 1.0, a shape of the toner becomes almost rotator having the main axis as a rotating axis. By satisfying this numeric requirement, the toner has a particle shape other than an irregular shape, compressed shape, and sphere. This is the shape that can attain all of friction charging ability, dot reproducibility, transfer efficiency, scattering inhibition, and cleaning ability.

The lengths showing with r1, r2 and r3 can be monitored and measured with a scanning electron microscope (SEM) by taking pictures from different angles.

The toner particles having an spindle shape and having the ratios r2/r1 and r3/r2 specified in the present invention can be prepared by controlling stirring conditions such as number of revolutions and stirring time and the concentration of the solvent in a process for removing the solvent in the production of the base toner-particle. If the solvent concentration is excessively high, the toner particles may hardly have an spindle shape. If it is excessively low, the toner particles tend to become spherical, although they once become elliptic. The toner of the present invention having an spindle shape can be prepared by stirring at an appropriate solvent concentration.

Two-Component Carriers

The toner of the present invention can be used in combination with a magnetic carrier in a two-component developer. The amount of the toner in the developer is preferably from 1 to 10 parts by weight relative to 100 parts by weight of the carrier. Such magnetic carriers include, for example, conventional magnetic particles with a particle diameter of about 20 to about 200 μm, made of iron, ferrite, magnetite, and magnetic resins. Coating materials for use herein include, but are not limited to, amine resins such as urea-formaldehyde resins, melamine resins, benzoguanamine resins, urea resins, polyamide resins, and epoxy resins; polyvinyl and polyvinylidene resins such as acrylic resins, poly (methyl methacrylate) resins, polyacrylonitrile resins, poly (vinyl acetate) resins, poly(vinyl alcohol) resins, poly(vinyl butyral) resins, polystyrene resins, styrene-acrylic copolymer resins, and other styrenic resins; poly(vinyl chloride)

and other halogenated olefin resins; poly(ethylene terephthalate) resins, poly(butylene terephthalate) resins, and other polyester resins; polycarbonate resins; polyethylene resins; poly(vinyl fluoride) resins, poly(vinylidene fluoride) resins, polytrifluoroethylene resins, polyhexafluoropropylene resins, copolymers of vinylidene fluoride and acrylic monomer, vinylidene fluoride-vinyl fluoride copolymers, terpolymers of tetrafluoroethylene, vinylidene fluoride, and a non-fluorinated monomer, and other fluoroterpolymers; and silicone resins. The resin for use in the coating material may further comprise a conductive powder according to necessity. Such conductive powders include, for example, powders of metals, carbon black, titanium oxide, tin oxide, and zinc oxide. These conductive powders preferably have an average particle diameter of 1 μm or less. If the average particle diameter exceeds 1 μm, the electric resistance of the developer may not sufficiently be controlled.

The toner of the present invention can also be used as a one-component magnetic or non-magnetic toner without using a carrier.

To further improve the fluidity, storage stability, developing properties, and transfer properties of the developer, the aforementioned hydrophobic silica fine particles, and other inorganic fine particles may be added to the above-prepared developer. These external additives can be mixed with the toner particles using a regular mixer for powders. The mixer for use herein preferably has a jacket or another unit to control its inner temperature. To change the hysteresis of a load applied to the external additive, the external additive may be added in the course of the mixing process or sequentially during the mixing process. Alternatively, the number of revolutions, the speed of tumbling, time period, and temperature of the mixer can be changed to change the hysteresis of the load. It is acceptable that a relatively high load is applied at early stages, and a relatively low load is then applied, or they can be applied in a retrograde order.

Examples of mixing systems for use herein are V mixers, rocking mixers, Ledige mixers, nauta mixers, and Henshel mixers.

The fixing device for use in the image forming process of the present invention is preferably a fixing device comprising a heater having a heating element, a film which is in contact with the heater, and a pressurizing member which in contact with the heater with the interposition of the film. In the fixing device, a recording medium bearing an unfixed toner image is inserted between the film and the pressurizing member so as to heat and fix the toner image on the recording medium. By using the fixing device, the image forming process can more efficiently form images with shorter rising time.

Figure 2:
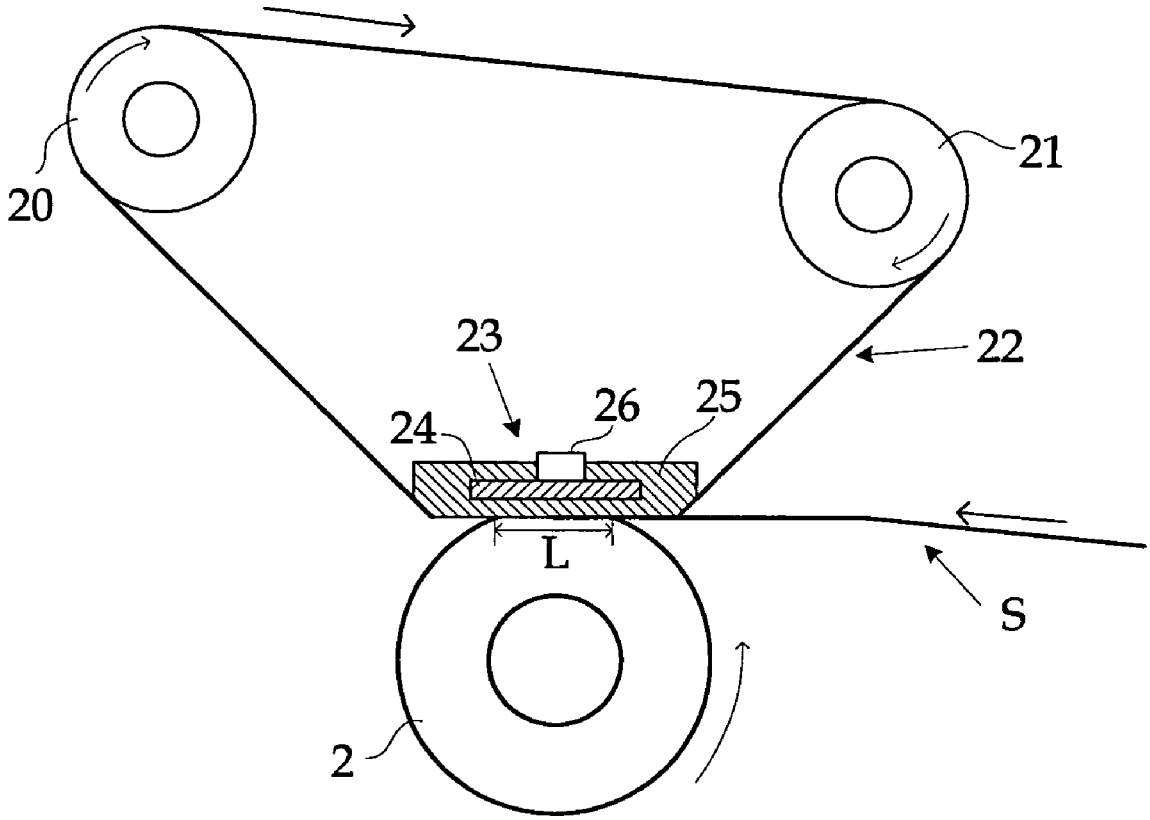
FIG. 2 is a schematic diagram showing an example of a fixing device in an image forming apparatus of the present invention.

With reference to FIG. 2, the fixing device is a SURF (surface rapid fusing) fixing device in which fixing is carried out by rotating a fixing film. Specifically, the fixing film 22 is a heat-resistant film in a form of an endless belt, and the fixing film 22 is spanned around a driving roller 20 which is a supportive rotator of the fixing film, a driven roller 21, and a heating member 23 which is disposed downside. In between the driving roller 20 and a driven roller 21, the fixing film 22 is supported by a flat substrate 25.

The driven roller 21 also works as a tension roller of the fixing film 22. The fixing film 22 is driven and thereby rotates in a clockwise rotating direction as shown in the figure by the driving roller 21. This rotating speed is controlled so to travel at the same speed as a transfer medium S in a nip region L in which the pressurizing roller 2 and the fixing film 22 come in contact with each other.

The pressurizing roller 2 has a rubber elastic layer having an excellent releasing ability, such as silicone rubber. The pressurizing roller 2 rotates in a counterclockwise direction so as to adjust a contact pressure at 4 kg to 10 kg with respect to the fixing nip region L.

The fixing film 22 preferably has excellent heat resistance, releasing ability and wearing resistance. The thickness thereof is generally 100 μm or less, and preferably 40 μm or less. Examples of the fixing film are single or multi layered film of heat resistant resins such as polyimide, poly(ether imide), PES (poly(ether sulfide)), and PFA (tetrafluoroethylene-perfluoroalkyl vinyl ether copolymer). Specific examples may be a film having a thickness of 20 μm in which a releasing coat layer of 10 μm thickness, formed of electroconducting agent-added fluoride resin such as PTFE (polytetrafluoroethylene resin), PFA, or an elastic layer such as fluorocarbon rubber or silicone rubber is disposed on the side in contact with an image.

In FIG. 2, the heating member 23 according to the present embodiment contains the flat substrate 25 and a fixing heater 24. The flat substrate 25 is formed of a material having high thermal conductivity and high electric resistance, such as alumina. On the surface of the heating member 23 where the fixing film 22 is in contact with, the fixing heater 24 formed of a resistant heating element is disposed so that the longer side of the fixing heater lies along the traveling direction of the fixing film. Such fixing heater 24 is, for example, screen printed with electric resistant material such as Ag/Pd or $Ta_2N$ in liner stripe or band stripe. Moreover, two electrodes (not shown) are disposed at both ends of fixing heater 24 so that the resistant heating element generates a heat by energizing between the electrodes. Further, on a side of the flat substrate 25 opposite to the fixing heater 24, a fixing thermal sensor 26 formed of thermistor is disposed.

Thermal information of the flat substrate 25 is detected by the fixing thermal sensor 26 and is sent to a controller so that quantity of electricity applied to the fixing heater 24 is controlled and thus the heating member 23 is controlled at a predetermined temperature.

The latent electrostatic image bearing member (photoconductor) for use in the image forming process of the present invention is preferably an amorphous silicon photoconductor. Such amorphous silicon photoconductors have high sensitivity with light with long wavelength, such as semiconductor laser light (770 nm to 800 nm), are resistant to degradation caused by repetitive use and are thereby used as electrophotographic photoconductors, for example, in high-speed copiers and laser beam printers (LBP).

Amorphous Silicon Photoconductor

In the present invention, an amorphous silicon photoconductor is used as a photoconductor for electrophotography. The amorphous silicon photoconductor (hereinafter referred to as a-Si photoconductor) has a substrate and a photoconductive layer formed of a-Si. The photoconductive layer is formed on the substrate by a film forming method such as vacuum deposition, sputtering, ion-plating, thermal CVD, optical CVD, plasma CVD, or the like. Of these, preferable method is plasma CVD in which raw material gas is decomposed by glow discharge of direct current, high frequency or microwave, and then a-Si is deposited on the substrate so as to form an a-Si film.

Layer Structure

Figure 3A:
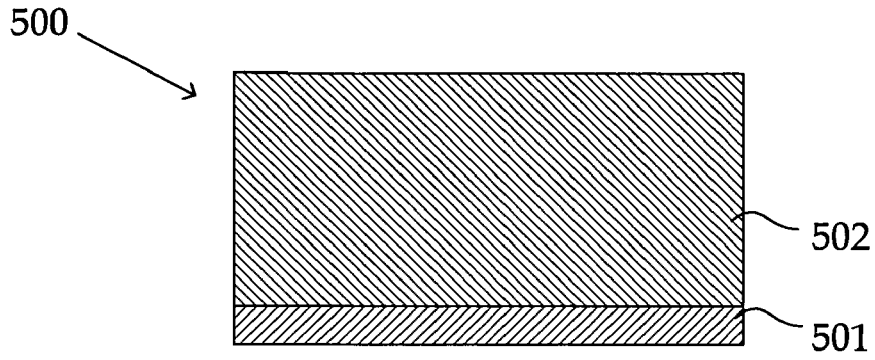
FIGS. 3A, 3B, 3C, and 3D are schematic diagrams showing an example of layer configuration of an amorphous silicon photoconductor for use in the present invention.
Figure 3B:
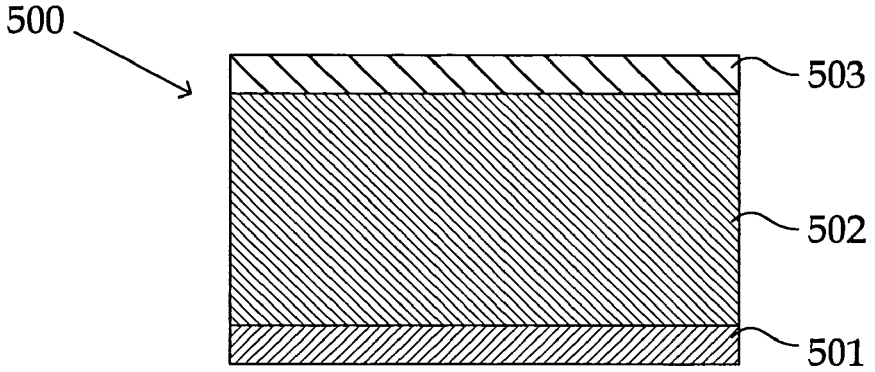
Figure 3C:
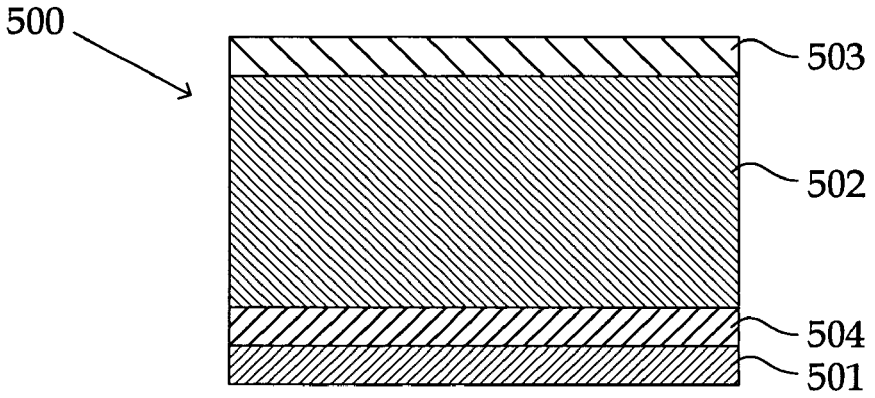
Figure 3D:
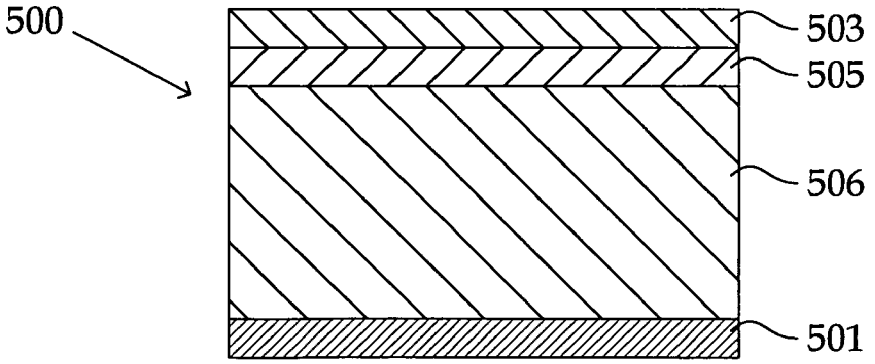

Examples of the layer structure of the amorphous silicon photoconductor are as follows. FIGS. 3A, 3B, 3C. and 3D are schematic diagrams which explain the layer structure of the amorphous silicon photoconductor. With reference to FIG. 3A, a photoconductor for electrophotography 500 has a substrate 501 and a photoconductive layer 502 on the substrate 501. The photoconductive layer 502 is formed of a-Si:H, X, and exhibits photoconductivity. With reference to FIG. 3B, a photoconductor for electrophotography 500 has a substrate 501, a photoconductive layer 502 formed of a-Si:H, X and an amorphous silicon surface layer 503 arranged on the substrate 501. With reference to FIG. 3C, a photoconductor for electrophotography 500 has a substrate 501, and on the substrate 501, a photoconductive layer 502 formed of a-Si:H, X, an amorphous silicon surface layer 503 and an amorphous silicon charge injection inhibiting layer 504. With reference to FIG. 3D, a photoconductor for electrophotography 500 has a substrate 501 and a photoconductive layer 502 on the substrate 501. The photoconductive layer 502 comprises a charge generation layer formed of a-Si:H, X 505 and a charge transport layer 506. The photoconductor for electrophotography 500 further has an amorphous silicon surface layer 503 on the photoconductive layer 502.

Substrate

The substrate of the photoconductor may be electrically conductive or insulative. Examples of the conductive substrate include metals such as Al, Cr, Mo, Au, In, Nb, Te, V, Ti, Pt, Pd, and Fe, and alloys thereof such as stainless steel. An insulative substrate in which at least a surface facing to a photoconductive layer is treated to yield conductivity can also be used as the substrate. Examples of such insulative substrates are a film or sheet of a synthetic resin such as a polyester, polyethylene, polycarbonate, cellulose acetate, polypropylene, polyvinyl chloride, polystyrene or polyamide, glass, or ceramic.

The shape of the substrate may be cylindrical, plate, or endless belt, which has a smooth or irregular surface. The thickness of thereof can be adjusted so as to form a predetermined photoconductor. In the case that flexibility is required to the photoconductor, the substrate can be as thinner as possible within ranges efficiently functioning as a substrate. The thickness of the substrate is generally 10 μm or more from the viewpoints of, for example, manufacture, handling, and mechanical strength.

Charge Injection Inhibiting Layer

In the photoconductor used in the present invention, it is effective to dispose a charge injection inhibiting layer between the conductive substrate and the photoconductive layer (FIG. 3C). The charge injection inhibiting layer inhibits a charge injection from the conductive substrate. The charge injection inhibiting layer has a polarity dependency. Namely, when charges of a specific polarity are applied to a free surface of the photoconductor, the charge injection inhibiting layer functions so as to inhibit a current injection from the conductive substrate to the photoconductive layer, and when charges of the opposite polarity are applied, the charge injection inhibiting layer does not function. In order to attain such function, the charge injection inhibiting layer contains relatively larger amounts of atoms which control a conductivity, compared with the photoconductive layer.

The thickness of the charge injection inhibiting layer is preferably about 0.1 μm to about 5 μm, more preferably 0.3 μm to 4 μm, and furthermore preferable 0.5 μm to 3 μm for desired electrophotographic properties and better economical efficiency.

Photoconductive Layer

The photoconductive layer 502 may be disposed above the substrate 501 according to necessity. The thickness of the photoconductive layer 502 is not particularly limited, as long as desired electrophotographic properties and high cost efficiency are obtained. The thickness is preferably about 1 μm to about 100 μm, more preferably 20 μm to 50 μm, and furthermore preferably 23 μm to 45 μm.

Charge Transport Layer

When the photoconductive layer is divided by its functions into plural layers, the charge transport layer mainly functions to transport currents. The charge transport layer comprises at least silicon atoms, carbon atoms, and fluorine atoms as its essential components. If needed, the charge transport layer may further comprise hydrogen atoms and oxygen atoms so that the charge transport layer is formed of a-SiC(H,F,O). Such charge transport layer exhibits desirable photoconductivity, especially charge holding property, charge generating property, and charge transporting property. It is particularly preferable that the charge transport layer contains an oxygen atom.

The thickness of the charge transport layer is suitably adjusted so as to yield desirable electrophotographic property and cost efficiency. The thickness thereof is preferably about 5 μm to about 50 μm, more preferably 10 μm to 40 μm, and the most preferably 20 μm to 30 μm.

Charge Generation Layer

When the photoconductive layers is divided by its functions into plural layers, the charge generation layer mainly functions to generate charges. The charge generation layer contains at least silicon atoms as an essential component and does not substantially contain a carbon atom. If needed, the charge generation layer may further comprise hydrogen atoms so that the charge generation layer is formed of a-Si:H. Such charge generation layer exhibits desirable photoconductivity, especially charge generating property and charge transporting property.

The thickness of the charge generation layer is suitably adjusted so as to yield desirable electrophotographic property and cost efficiency. The thickness thereof is preferably about 0.5 μm to about 15 μm, more preferably 1 μm to 10 μm, and the most preferably 1 μm to 5 μm.

Surface Layer

The amorphous silicon photoconductor for use in the present invention may further contain a surface layer disposed on the photoconductive layer on the substrate as mentioned above. The surface layer is preferably an amorphous silicon layer. The surface layer has a free surface so that desirable properties such as moisture resistance, usability in continuous repeated use, electric strength, stability in operating environment, and durability.

The thickness of the surface layer is generally about 0.01 μm to about 3 μm, preferably 0.05 μm to 2 μm, and more preferably 0.1 μm to 1 μm. If the thickness is less than about 0.01 μm, the surface layer is worn out during usage of the photoconductor. If it exceeds about 3μm, electrophotographic properties are impaired such as an increase of residual charge.

In the image forming process of the present invention, an alternating field is preferably applied when a latent electrostatic image on the photoconductor is developed. Thus, a vibrating bias voltage comprising both a direct-current voltage and an alternating current voltage is applied upon the development of a latent electrostatic image on the photoconductor, and the resulting image has a smooth appearance with high precision.

Figure 4:
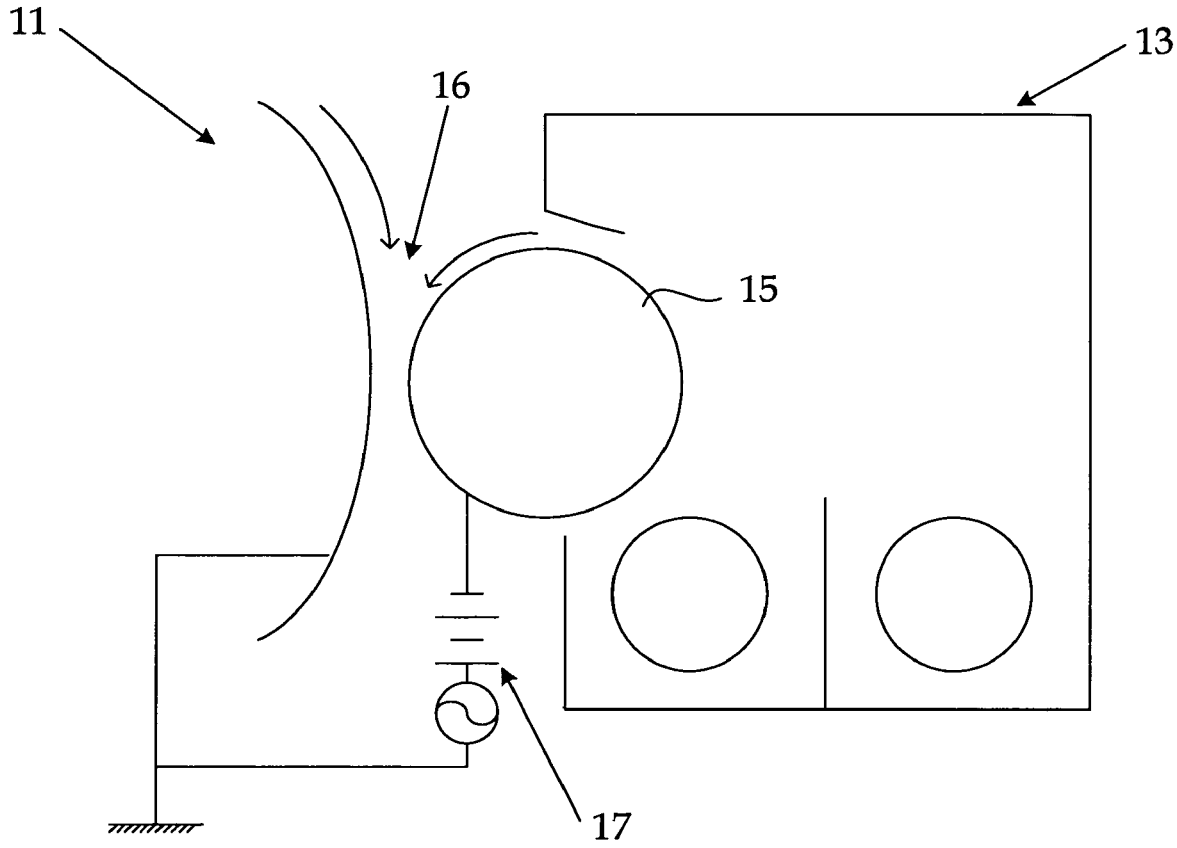
FIG. 4 is a schematic diagram of an example of a developing device in an image forming process of the present invention, which applies an alternating field.

In an image developing device according to the present embodiment shown in FIG. 4, a power supply 17 applies a vibration bias voltage as developing bias, in which a direct-current voltage and an alternating voltage are superimposed, to a developing sleeve 15 during developing. The potential of background part and the potential of image part are positioned between the maximum and the minimum of the vibration bias potential. This forms an alternating field, whose direction alternately changes, at developing region 16. A toner and a carrier in the developer are intensively vibrated in this alternating field, so that the toner overshoots the electrostatic force of constraint from the developing sleeve 15 and the carrier, and leaps to the photoconductor 11. The toner is then attached to the photoconductor in accordance with a latent electrostatic image thereon.

The difference between the maximum and the minimum of the vibration bias voltage (peak-to-peak voltage) is preferably 0.5 kV to 5 kV, and the frequency is preferably 1 kHz to 10 kHz. The waveform of the vibration bias voltage may be a rectangle wave, a sine wave, or a triangle wave. The direct-current voltage of the vibration bias voltage is in a range between the potential at the background and the potential at the image as mentioned above, and is preferable set closer to the potential at the background from viewpoints of inhibiting a toner deposition on the background.

When the vibration bias voltage is a rectangle wave, it is preferred that a duty ratio is 50% or less. The duty ratio is a ratio of time when the toner leaps to the photoconductor during a cycle of the vibration bias. In this way, the difference between the peak time value when the toner leaps to the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier having an opposite polarity of current to the toner leaps to the photoconductor and the time average value of bias can be decreased. Consequently the movement of the carrier can be restrained and the possibility of the carrier deposition on the background is largely reduced.

The electrostatic charger for use in the image forming process of the present invention is preferably a contact charger. Such a charger contains an electrostatic charging member, and the electrostatic charging member is brought in contact with the photoconductor and applies voltage so as to charge the photoconductor. By using this charger, the image forming process can be performed with less formation of ozone.

Roller Charger

Figure 5:
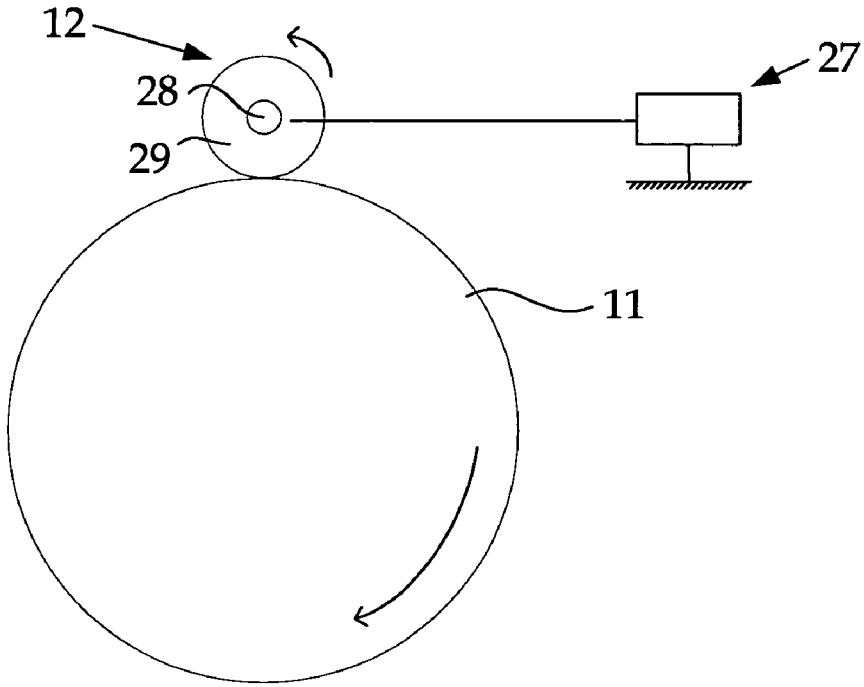
FIG. 5 is a schematic diagram of an example of an image forming process using a contact electrostatic charger.

FIG. 5 is a schematic diagram of an example of the image-forming apparatus that equips a contact charger. The photoconductor 11 to be charged as an image bearing member is rotated at a predetermined speed (process speed) in the direction shown with the arrow in the figure. The charging roller 12, which is brought into contact with the photoconductor 11, contains a core rod and a conductive rubber layer formed on the core rod in a shape of a concentric circle. The both terminals of the core rod are supported with bearings (not shown) so that the charging roller enables to rotate freely, and the charging roller 12 is pressed to the photoconductor 11 at a predetermined pressure by a pressurizing member (not shown). The charging roller 12 in this figure therefore rotates along with the rotation of the photoconductor 11. The charging roller 12 is generally formed with a diameter of 16 mm in which a core rod 28 having a diameter of 9 mm is coated with a rubber layer 29 having a moderate resistance of approximately 100,000 Ω·cm.

The power supply 27 shown in the figure is electrically connected with the core rod 28, and a predetermined bias is applied to the core rod 28 by the power supply. Thus, the surface of the photoconductor is uniformly charged at a predetermined polarity and potential.

As a charger for use in the present invention, the shape thereof is not specifically limited and can for example be, apart from a roller, a magnetic brush or a fur brush. It can be suitably selected according to a specification or configuration of an image-forming apparatus. When a magnetic brush is used as a charger, the magnetic brush contains an electrostatic charger formed of various ferrite particles such as Zn—Cu ferrite, a non-magnetic conductive sleeve to support the electrostatic charger, and a magnetic roller contained in the non-magnetic conductive sleeve. When a fur brush is used as a charger, a material of the fur brush is, for example, a fur that becomes conductive by treatment with, for example, carbon, copper sulfide, a metal or a metal oxide, and the fur is coiled or mounted to a metal or another core rod which becomes conductive by treatment.

Fur Brush Charger

Figure 6:
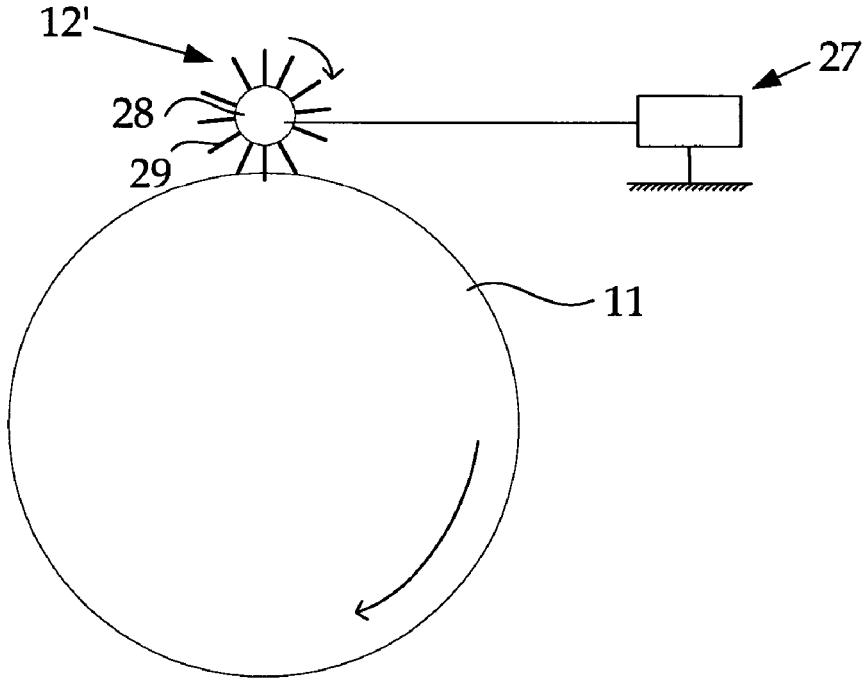
FIG. 6 is a schematic diagram of another example of an image forming process using a contact electrostatic charger.

FIG. 6 is a schematic diagram of another example of the image-forming apparatus that equips a contact charger. The photoconductor 11 as an object to be charged and image bearing member, is rotated at a predetermined speed (process speed) in the direction shown with the arrow in the figure. The brush roller 12 having a fur brush is brought in contact with the photoconductor 11, with a predetermined nip width and a predetermined pressure with respect to elasticity of the brush part.

The fur brush roller 12 as the contact charger used in the present invention has an outside diameter of 14 mm and a longitudinal length of 250 mm. In this fur brush, a tape with a pile of conductive rayon fiber REC-B (trade name, available from Unitika Ltd.), as a brush part, is spirally coiled around a metal core rod 28 having a diameter of 6 mm, which is also functioned as an electrode. The brush of the brush part 29 is of 300 denier/50 filament, and a density of 151 fibers per 1 square millimeter. This role brush is once inserted into a pipe having an internal diameter of 12 mm with rotating in a certain direction, and is set so as to be a concentric circle relative to the pipe. Thereafter, the role brush in the pipe is left in an atmosphere of high humidity and high temperature so as to twist the fibers of the fur.

The resistance of the fur brush roller 12' is $1\times10^5\Omega$ at an applied voltage of 100 V. This resistance is calculated from the current obtained when the fur brush rolled is contacted with a metal drum having a diameter of 30 mm with a nip width of 3 mm, and a voltage of 100 V is applied thereon.

The resistance of the fur brush roller 12 should be $10^4\Omega$ or more in order to prevent image imperfection caused by an insufficient charge at the charging nip part when the photoconductor 11 to be charged happens to have low electric strength defects such as pin holes thereon and an excessive leak current therefore runs into the defects. Moreover, it should be $10^4\Omega$ or less in order to sufficiently charge the surface of the photoconductor 11.

Examples of the material of the fur include, in addition to REC-B (trade name, available from Unitika Ltd.), REC-C, REC-M1, REC-M10 (trade names, available from Unitika Ltd.), SA-7 (trade name, available from Toray Industries, Inc.), Thunderon (trade name, available from Nihon Sanmo Dyeing Co., Ltd.), Beltron (trade name, available from Kanebo Gohsen, Ltd.), Kuracarbo in which carbon is dispersed in rayon (trade name, available from Kuraray Co., Ltd.), and Roval (trade name, available from Mitsubishi Rayon Co., Ltd.). The brush is of preferably 3 to 10 denier per fiber, 10 to 100 filaments per bundle, and 80 to 600 fibers per square millimeter. The length of the fur is preferably 1 to 10 mm.

The fur brush roller 12' is rotated in the opposite (counter) direction to the rotation direction of the photoconductor 11 at a predetermined peripheral velocity, and comes into contact with the photoconductor 11 with a velocity deference. The power supply 27 applies a predetermined charging voltage to the fur brush roller 12' so that the surface of the photoconductor 11 is uniformly charged at a predetermined polarity and potential. In contact charge of the photoconductor 11 by the fur brush roller 12 of the present embodiment, charges are mainly directly injected and the surface of the photoconductor 11 is charged at the substantially equal voltage to the applying charging voltage to the fur brush roller 12.

Magnetic Brush Charger

FIG. 6 is a schematic diagram of yet another example of the image-forming apparatus that equips a contact charger. The photoconductor 11 to be charged and image bearing member is rotated at a predetermined speed (process speed) in the direction shown with the arrow in the figure. The brush roller 12 having a magnetic brush is brought in contact with the photoconductor 11, with a predetermined nip width and a predetermined pressure with respect to elasticity of the brush part.

The magnetic brush 29 as a contact charger of the present embodiment is formed of magnetic particles. In the magnetic particles, Z-Cu ferrite particles having an average particle diameter of 25 μm and Z-Cu ferrite particles having an average particle diameter of 10 μm are mixed in a ratio of 1/0.05 so as to form ferrite particles having peaks at each average particle diameter, and a total average particle diameter of 25 μm. The ferrite particles are coated with a resin layer having a moderate resistance so as to form the magnetic particles. The contact charger of this embodiment formed from the above-mentioned coated magnetic particles, a non-magnetic conductive sleeve 28 which supports the coated magnetic particles, and a magnet roller which is included in the non-magnetic conductive sleeve 28. The coated magnetic particles are disposed on the sleeve with a thickness of 1 mm so as to form a charging nip 5 mm wide with the photoconductor 11. The width between the non-magnetic conductive sleeve 28 and the photoconductor 11 is adjusted to approximately 500 μm. The magnetic roller 12' is rotated so as to subject the non-magnetic conductive sleeve 28 to rotate at twice in speed relative to the peripheral speed of the surface of the photoconductor 11, and in the opposite direction with the photoconductor 11. Therefore, the magnetic brush 29 is uniformly in contact with the photoconductor 11.

Figure 7:
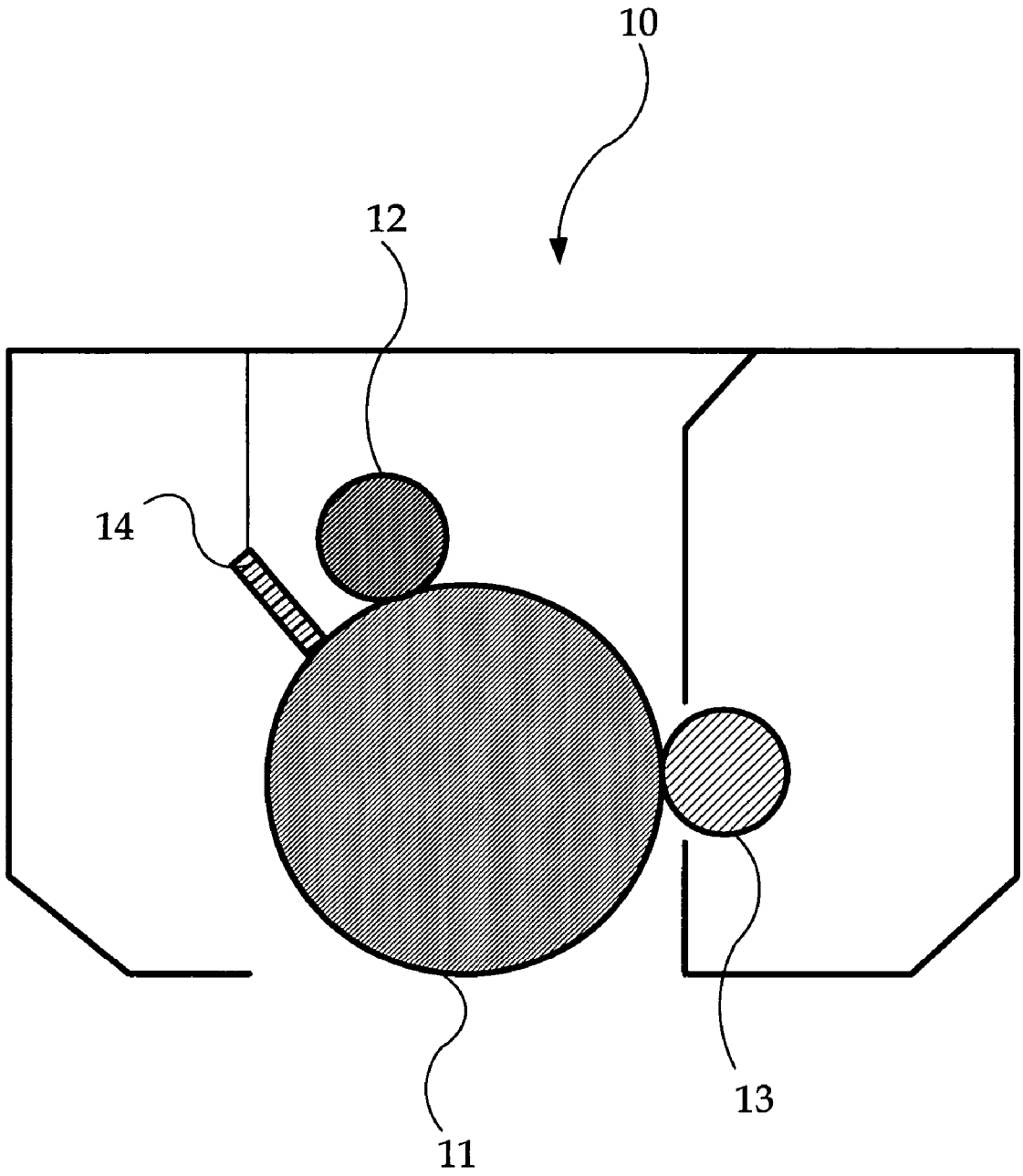
FIG. 7 is a schematic diagram showing an example of an image forming apparatus comprising a process cartridge of the present invention.

FIG. 7 is a schematic diagram of an image forming apparatus having the process cartridge according to the present invention. The process cartridge 10 supports developing unit holding the toner of the present invention.

The process cartridge comprises at least a photoconductor 11 and developing unit 13 and may further comprise other components such as charger 12 and cleaner 14. These components are integrated as the process cartridge which is detachable from a main body of an image forming apparatus such as a copier or a printer.

The present invention also relates to an image forming apparatus having developing unit holding the toner of the present invention. A fixing device for use in the image forming apparatus is preferably the aforementioned fixing device comprising a heating member having a heating element, a film in contact with the heating member, and a pressurizing member in contact with the heating member with the interposition of the film, in which the fixing device is so configured as to allow a recording medium bearing an unfixed image to pass between the film and the pressurizing member. By using the fixing device, the image forming apparatus can more efficiently form images with shorter rising time.

The present invention will be illustrated in further detail with reference to several examples and comparative examples below, which are never intended to limit the scope of the present invention. "part" and "parts" written in below refer "part by weight" and "parts by weight", respectively.

PREPARATION EXAMPLE 1

Preparation of Organic Fine Particle Emulsion

In a reactor equipped with a stirring rod and a thermometer were placed 653 parts of water, 11 parts of a sodium salt of sulfuric acid ester of ethylene oxide adduct of methacrylic acid ELEMINOL RS-30 (trade name, available from Sanyo Chemical Industries, Ltd., Japan), 83 parts of styrene, 83 parts of methacrylic acid, 110 parts of butyl acrylate, and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium sulfate, was aged at 75° C. for 5 hours and thereby yielded an aqueous dispersion [Fine Particle Dispersion 1] of a vinyl resin (a copolymer of styrene-methacrylic acid-butyl acrylate-sodium salt of sulfuric acid ester of ethylene oxide adduct of methacrylic acid). Fine Particle Dispersion 1 had a volume-average particle diameter of 105 nm when measured with a laser diffraction-scattering size distribution analyzer LA-920 (trade name, available from Horiba, Ltd., Japan). Part of Fine Particle Dispersion 1 was dried to isolate the resin component. The resin component had a Tg of 59° C. and a weight-average molecular weight of $15\times10^4$.

PREPARATION EXAMPLE 2

Preparation of Aqueous Phase

Aqueous Phase 1 was prepared as an opaque liquid by blending and stirring 990 parts of water, 99 parts of Fine Particle Dispersion 1, 35 parts of a 48.5% aqueous solution of sodium dodecyl diphenyl ether disulfonate ELEMINOL MON-7 (trade name, available from Sanyo Chemical Industries, Ltd., Japan), and 70 parts of ethyl acetate.

PREPARATION EXAMPLE 3

Preparation of Low-Molecular Weight Polyester

In a reactor equipped with a condenser, a stirrer and a nitrogen gas feed tube were placed 229 parts of an ethylene oxide (2 mole) adduct of bisphenol A, 529 parts of a propylene oxide (3 mole) adduct of bisphenol A, 208 parts of terephthalic acid, 46 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. The reaction mixture was further treated with 44 parts of trimellitic anhydride at 180° C. at normal atmospheric pressure for 1.8 hours and thereby yielded Low-molecular Weight Polyester 1. Low-molecular Weight Polyester 1 had a number-average molecular weight of 2500, a weight-average molecular weight of 6700, a peak molecular weight of 5,000, a Tg of 43° C., and an acid value of 25.

PREPARATION EXAMPLE 4

Preparation of Prepolymer 1

In a reactor equipped with a condenser, a stirrer and a nitrogen gas feed tube were placed 682 parts of ethylene oxide (2 mole) adduct of bisphenol A, 81 parts of a propylene oxide (2 mole) adduct of bisphenol A, 283 parts of terephthalic acid, 22 parts of trimellitic anhydride and 2 parts of dibutyltin oxide. The mixture was reacted at 230° C. at normal atmospheric pressure for 8 hours, was further reacted under a reduced pressure of 10 mmHg to 15 mmHg for 5 hours and thereby yielded Intermediate Polyester 1 having a number-average molecular weight of 2100, a weight-average molecular weight of 9500, a Tg of 55° C., an acid value of 0.5 and a hydroxyl value of 51.

In a reactor equipped with a condenser, a stirrer and a nitrogen gas feed tube were placed 410 parts of Intermediate Polyester 1, 89 parts of isophorone diisocyanate, and 500 parts of ethyl acetate, followed by reaction at 100° C. for 5 hours to yield Prepolymer 1 having a free isocyanate content of 1.53% by weight.

PREPARATION EXAMPLE 5

Synthesis of Ketimine Compound 1

In a reactor equipped with a stirring rod and a thermometer were placed 170 parts of isophoronediamine and 75 parts of methyl ethyl ketone, followed by reaction at 50° C. for 5 hours to yield Ketimine Compound 1 having an amine value of 418.

PREPARATION EXAMPLE 6

Preparation of Master Batch

A total of 1200 parts of water, 800 parts of carbon black Regal 400 R (trade name, available from Cabot Corp.; DBP oil absorbance: 71 ml/100-mg), and 1200 parts of a polyester resin was mixed in a Mitsui Henschel Mixer (trade name, available from Mitsui Mining Co., Ltd.). The mixture was kneaded at 150° C. for 30 minutes in a two-roll mill, was cold-rolled, was pulverized in a pulverizer and thereby yielded Master Batch 1.

PREPARATION EXAMPLE 7

Preparation of Oil Phase

In a reactor equipped with a stirring rod and a thermometer were placed 378 parts of Low-molecular Weight Polyester 1, 110 parts of carnauba wax, and 947 parts of ethyl acetate. The mixture was heated at 80° C. for 5 hours with stirring and was then cooled to 30° C. over 1 hour. The mixture was further treated with 400 parts of Master Batch 1 and 500 parts of ethyl acetate with stirring for 1 hour and thereby yielded Material Solution 1.

Next, 1324 parts of Material Solution 1 was placed in a vessel, and the carbon black and wax components therein were dispersed using a bead mill (ULTRAVISCO-MILL available from Aimex Co., Ltd., Japan) at a liquid feeding speed of 1 kg/hr, a disc rotation speed of 6 m/sec., using zirconia beads 0.5 mm in diameter filled 80% by volume at a repetitive number. The dispersing procedure was repeated a total of three times. The dispersion was further treated with 1324 parts of a 65% ethyl acetate solution of Low-molecular Weight Polyester 1, and the mixture was dispersed under the above conditions except that the dispersion procedure was performed once to yield Pigment-wax Dispersion 1. Pigment-wax Dispersion 1 had a solid content of 50% as determined by heating the dispersion at 130° C. for 30 minutes.

EXAMPLE 1

Emulsification and Solvent Removal

In a vessel were placed 749 parts of Pigment-wax Dispersion 1, 115 parts of Prepolymer 1, and 2.9 parts of Ketimine Compound 1, and the mixture was mixed at 5,000 rpm for 1 minute using a T.K. HOMO MIXER (trade name, available from Tokushu Kika Kogyo Co., Ltd., Japan). Next, 1,200 parts of Aqueous Phase 1 were added thereto, the mixture was dispersed at 12500 rpm for 30 minutes using a T.K. HOMO MIXER and thereby yielded Emulsified Slurry 1.

In a vessel equipped with a stirrer and a thermometer was placed Emulsified Slurry 1 and was heated at 35° C. for 7 hours to remove the solvents therefrom. The slurry was aged at 45° C. for 4 hours and thereby yielded Dispersed Slurry 1.

Washing and Drying

A total of 100 parts of Emulsified Slurry 1 was filtered under a reduced pressure and was washed by the following procedures.

(1) The filtered cake and 100 parts of deionized water were mixed in a T.K. HOMO MIXER at 12,000 rpm for 10 minutes ,and the mixture was filtered.

(2) The filtered cake prepared in (1) and 100 parts of a 10% aqueous solution of sodium hydroxide were mixed in a T.K. HOMO MIXER at 12,000 rpm for 30 minutes, and the mixture was filtered under a reduced pressure.

(3) The filtered cake prepared in (2) and 100 parts of a 10% hydrochloric acid were mixed in a T.K. HOMO MIXER at 12,000 rpm for 10 minutes, and the mixture was filtered.

(4) The filtered cake prepared in (3) and 300 parts of deionized water were mixed in a T.K. HOMO MIXER at 12,000 rpm for 10 minutes, and the mixture was filtered, wherein this washing procedure was further repeated twice to yield Filtered Cake 1.

Filtered Cake 1 was dried at 45° C. for 48 hours in a circulating air dryer, was sieved with a 75-μm mesh sieve and thereby yielded Base toner-particle 1. Base toner-particle 1 had a volume-average particle diameter of 4.5 μm and a number-average particle diameter of 3.5 μm. It was verified that organic fine particles adhered to the surface of Base toner-particle 1.

Addition of Charge Control Agent and External Additive

Next, 100 parts of Base toner-particle 1 and 0.5 part of a metal complex of salicylic acid Bontron E-84 (trade name, available from Orient Chemical Industries, Ltd., Japan) as a charge control agent were mixed at 1,000 rpm in a Henschel Mixer and was further mixed at 6,000 rpm in a Q Mixer (available from Mitsui Mining Co., Ltd., Japan) to thereby apply the charge control agent to the surface of the base toner-particle. The resulting article and 0.7 part of hydrophobic titanium oxide were mixed at 1500 rpm with a Henschel Mixer and thereby yielded Toner 1.

PREPARATION EXAMPLE 8

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd., Japan), 80 parts of styrene, 83 parts of methacrylic acid, 110 parts of butyl acrylate, 12 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium sulfate, was aged at 75° C. for 5 hours and thereby yielded an aqueous dispersion Fine Particle Dispersion 2 of a vinyl resin (a copolymer of styrene-methacrylic acid-butyl acrylate-sodium salt of sulfuric acid ester of ethylene oxide adduct of methacrylic acid). Fine Particle Dispersion 2 had a volume-average particle diameter of 120 nm when measured with a laser diffraction-scattering size distribution analyzer LA-920. Part of Fine Particle Dispersion 2 was dried to isolate the resin component. The resin component had a Tg of 42° C. and a weight-average molecular weight of $3\times10^4$.

EXAMPLE 2

Toner 2 was prepared by the procedure of Example 1, except that Fine Particle Dispersion 2 was used instead of Fine Particle Dispersion 1.

PREPARATION EXAMPLE 9

Preparation of Organic Fine Particle Dispersion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd., Japan), 103 parts of styrene, 83 parts of methacrylic acid, 90 parts of butyl acrylate, 12 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium sulfate, was aged at 75° C. for 5 hours and thereby yielded an aqueous dispersion [Fine Particle Dispersion 3] of a vinyl resin (a copolymer of styrene-methacrylic acid-butyl acrylate-sodium salt of sulfuric acid ester of ethylene oxide adduct of methacrylic acid). Fine Particle Dispersion 3 had a volume-average particle diameter of 110 nm when measured with a laser diffraction-scattering size distribution analyzer LA-920. Part of Fine Particle Dispersion 3 was dried to isolate the resin component. The resin component had a Tg of 78° C. and a weight-average molecular weight of $2.5\times10^4$.

EXAMPLE 3

Toner 3 was prepared by the procedure of Example 1, except that Fine Particle Dispersion 3 was used instead of Fine Particle Dispersion 1.

PREPARATION EXAMPLE 10

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd., Japan), 78 parts of styrene, 83 parts of methacrylic acid, 115 parts of butyl acrylate, 2 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium sulfate, was aged at 75° C. for 5 hours and thereby yielded an aqueous dispersion [Fine Particle Dispersion 4] of a vinyl resin (a copolymer of styrene-methacrylic acid-butyl acrylate-sodium salt of sulfuric acid ester of ethylene oxide adduct of methacrylic acid). Fine Particle Dispersion 4 had a volume-average particle diameter of 115 nm when measured with a laser diffraction-scattering size distribution analyzer LA-920. Part of Fine Particle Dispersion 4 was dried to isolate the resin component. The resin component had a Tg of 51° C. and a weight-average molecular weight of $10\times10^4$.

EXAMPLE 4

Toner 4 was prepared by the procedure of Example 1, except that Fine Particle Dispersion 4 was used instead of Fine Particle Dispersion 1 and that hydrophobic silica was used as an external additive instead of hydrophobic titanium oxide.

PREPARATION EXAMPLE 11

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd., Japan), 68 parts of styrene, 93 parts of methacrylic acid, 115 parts of butyl acrylate, and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium sulfate, was aged at 75° C. for 5 hours and thereby yielded an aqueous dispersion [Fine Particle Dispersion 5] of a vinyl resin (a copolymer of styrene-methacrylic acid-butyl acrylate-sodium salt of sulfuric acid ester of ethylene oxide adduct of methacrylic acid). Fine Particle Dispersion 5 had a volume-average particle diameter of 90 nm when measured with a laser diffraction-scattering size distribution analyzer LA-920. Part of Fine Particle Dispersion 5 was dried to isolate the resin component. The resin component had a Tg of 56° C. and a weight-average molecular weight of $15\times10^4$.

PREPARATION EXAMPLE 12

Preparation of Oil Phase

Material Solution 2 was prepared by the procedure of Preparation Example 7, except that rice wax was used instead of carnauba wax.

Next, 1324 parts of Material Solution 2 was placed in a vessel, and the carbon black and wax components therein were dispersed using a bead mill (ULTRAVISCO-MILL available from Aimex Co., Ltd., Japan) at a liquid feeding speed of 1 kg/hr, a disc rotation speed of 6 m/sec., using zirconia beads 0.5 mm in diameter filled 80% by volume at a repetitive number. The dispersing procedure was repeated a total of three times. The dispersion was further treated with 1324 parts of a 65% ethyl acetate solution of Low-molecular Weight Polyester 1, and the mixture was dispersed under the above conditions except that the dispersion procedure was performed once to yield Pigment-wax Dispersion 2. Pigment-wax Dispersion 2 had a solid content of 50% as determined by heating the dispersion at 130° C. for 30 minutes.

EXAMPLE 5

Base toner-particle 5 was prepared by the procedure of Example 1, except that Fine Particle Dispersion 5 and Pigment-wax Dispersion 2 were used instead of Fine Particle Dispersion 1 and Pigment-wax Dispersion 1, respectively.

Next, 100 parts of Base toner-particle 5 and 0.5 part of a metal complex of salicylic acid Bontron E-84 (trade name, available from Orient Chemical Industries, Ltd., Japan) as a charge control agent were mixed at 1,000 rpm in a Henschel Mixer and was further mixed at 6,000 rpm in a Q Mixer (available from Mitsui Mining Co., Ltd., Japan) to thereby apply the charge control agent to the surface of the base toner-particle.

Toner 5 was then prepared by the procedure of Example 1, except that the above-prepared article was used and that hydrophobic silica was used instead of hydrophobic titanium oxide.

PREPARATION EXAMPLE 13

Preparation of Oil Phase

Material Solution 3 was prepared by the procedure of Preparation Example 7, except that montan wax was used instead of carnauba wax.

Next, 1324 parts of Material Solution 3 was placed in a vessel, and the carbon black and wax components therein were dispersed using a bead mill (ULTRAVISCO-MILL available from Aimex Co., Ltd., Japan) at a liquid feeding speed of 1 kg/hr, a disc rotation speed of 6 m/sec., using zirconia beads 0.5 mm in diameter filled 80% by volume at a repetitive number. The dispersing procedure was repeated a total of three times. The dispersion was further treated with 1324 parts of a 65% ethyl acetate solution of Low-molecular Weight Polyester 1, and the mixture was dispersed under the above conditions except that the dispersion procedure was performed once to yield Pigment-wax Dispersion 3. Pigment-wax Dispersion 3 had a solid content of 50% as determined by heating the dispersion at 130° C. for 30 minutes.

PREPARATION EXAMPLE 14

In a vessel were placed 753 parts of Pigment-wax Dispersion 3, 154 parts of Prepolymer 1, and 3.8 parts of Ketimine Compound 1, and the mixture was mixed at 5,000 rpm for 1 minute using a T.K. HOMO MIXER (trade name, available from Tokushu Kika Kogyo Co., Ltd., Japan). Next, 1,200 parts of Aqueous Phase 1 were added thereto, the mixture was dispersed at 13,000 rpm for 20 minutes using a T.K. HOMO MIXER and thereby yielded Emulsified Slurry 6.

EXAMPLE 6

Toner 6 was prepared by the procedure of Example 1, except that Emulsified Slurry 6 was used instead of Emulsified Slurry 1 and that the sample was transferred to a T.K. HOMO MIXER on the way of removal of the solvents, was stirred therein at 12,500 rpm for 40 minutes and thereby yielded a toner having an spindle shape.

PREPARATION EXAMPLE 15

Synthesis of Low-Molecular Weight Polyester

In a reactor equipped with a condenser tube, a stirrer and a nitrogen gas feed tube were placed 196 parts of a propylene oxide (2 mole) adduct of bisphenol A, 553 parts of an ethylene oxide (2 mole) adduct of bisphenol A, 210 parts of terephthalic acid, 79 parts of adipic acid, and 2 parts of dibutyltin oxide. The mixture was reacted at 230° C. at normal atmospheric pressure for 8 hours and was further reacted at a reduced pressure of 10 mmHg to 15 mmHg for 5 hours. The reaction mixture was further treated with 26 parts of trimellitic anhydride at 180° C. at normal atmospheric pressure for 2 hours and thereby yielded Low-molecular Weight Polyester 2. Low-molecular Weight Polyester 2 had a number-average molecular weight of 2,400, a weight-average molecular weight of 6,200, a peak molecular weight of 5,200, a Tg of 43° C., and an acid value of 15.

PREPARATION EXAMPLE 16

Preparation of Oil Phase

Material Solution 4 was prepared by the procedure of Preparation Example 7, except that ester wax was used instead of carnauba wax.

Next, 1324 parts of Material Solution 4 was placed in a vessel, and the carbon black and wax components therein were dispersed using a bead mill (ULTRAVISCO-MILL available from Aimex Co., Ltd., Japan) at a liquid feeding speed of 1 kg/hr, a disc rotation speed of 6 m/sec., using zirconia beads 0.5 mm in diameter filled 80% by volume at a repetitive number. The dispersing procedure was repeated a total of three times. The dispersion was further treated with 1324 parts of a 65% ethyl acetate solution of Low-molecular Weight Polyester 1, and the mixture was dispersed under the above conditions except that the dispersion procedure was performed once to yield Pigment-wax Dispersion 4. Pigment-wax Dispersion 4 had a solid content of 50% as determined by heating the dispersion at 130° C. for 30 minutes.

EXAMPLE 7

Toner 7 was prepared by the procedure of Example 5, except that Low-molecular Weight Polyester 2 and Pigment-wax Dispersion 4 were used instead of Low-molecular Weight Polyester 1 and Pigment-wax Dispersion 2, and that the sample was transferred into a T.K. HOMO MIXER on the way of removal of the solvents, was stirred therein at 13,000 rpm for 30 minutes and thereby yielded a toner having an spindle shape.

PREPARATION EXAMPLE 17

Preparation of Oil Phase

In a reactor equipped with a stirring rod and a thermometer were placed 378 parts of Low-molecular Weight Polyester 1, 100 parts of a metal complex of salicylic acid Bontron E-84 (trade name, available from Orient Chemical Industries, Ltd., Japan), 110 parts of carnauba wax, and 947 parts of ethyl acetate. The mixture was heated at 80° C. for 5 hours with stirring and was then cooled to 30° C. over 1 hour. The mixture was further treated with 400 parts of Master Batch 1 and 500 parts of ethyl acetate with stirring for 1 hour and thereby yielded Material Solution 5.

Next, 1324 parts of Material Solution 5 was placed in a vessel, and the carbon black and wax components therein were dispersed using a bead mill (ULTRAVISCO-MILL available from Aimex Co., Ltd., Japan) at a liquid feeding speed of 1 kg/hr, a disc rotation speed of 6 m/sec., using zirconia beads 0.5 mm in diameter filled 80% by volume at a repetitive number. The dispersing procedure was repeated a total of three times. The dispersion was further treated with 1324 parts of a 65% ethyl acetate solution of Low-molecular Weight Polyester 1, and the mixture was dispersed under the above conditions except that the dispersion procedure was performed once to yield Pigment-wax Dispersion 5. Pigment-wax Dispersion 5 had a solid content of 50% as determined by heating the dispersion at 130° C. for 30 minutes.

PREPARATION EXAMPLE 18

Preparation of Aqueous Phase

Aqueous Phase 6 was prepared as an opaque liquid by blending and stirring 990 parts of water, 62 parts of Fine Particle Dispersion 1, 37 parts of a 48.5% aqueous solution of sodium dodecyl diphenyl ether disulfonate ELEMINOL MON-7 (trade name, available from Sanyo Chemical Industries, Ltd., Japan), and 90 parts of ethyl acetate.

COMPARETIVE EXAMPLE 1

Toner 8 was prepared by the procedure of Example 1, except that Pigment-wax Dispersion 5 and Aqueous Phase 6 were used instead of Pigment-wax Dispersion 1 and Aqueous Phase 1, respectively.

PREPARATION EXAMPLE 19

Preparation of Aqueous Phase

Aqueous Phase 7 was prepared as an opaque liquid by blending and stirring 990 parts of water, 77 parts of Fine Particle Dispersion 1, 37 parts of a 48.5% aqueous solution of sodium dodecyl diphenyl ether disulfonate ELEMINOL MON-7 (trade name, available from Sanyo Chemical Industries, Ltd., Japan), and 90 parts of ethyl acetate.

COMPARETIVE EXAMPLE 2

Toner 9 was prepared by the procedure of Example 1, except that Pigment-wax Dispersion 5 and Aqueous Phase 7 were used instead of Pigment-wax Dispersion 1 and Aqueous Phase 1, respectively.

PREPARATION EXAMPLE 20

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd., Japan), 138 parts of styrene, 138 parts of methacrylic acid and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium sulfate, was aged at 75° C. for 5 hours and thereby yielded an aqueous dispersion [Fine Particle Dispersion 6] of a vinyl resin (a copolymer of styrene-methacrylic acid-butyl acrylate-sodium salt of sulfuric acid ester of ethylene oxide adduct of methacrylic acid). Fine Particle Dispersion 6 had a volume-average particle diameter of 140 nm when measured with a laser diffraction-scattering size distribution analyzer LA-920. Part of Fine Particle Dispersion 6 was dried to isolate the resin component. The resin component had a Tg of 152° C. and a weight-average molecular weight of $40\times10^4$.

COMPARETIVE EXAMPLE 3

Toner 10 was prepared by the procedure of Example 1, except that Pigment-wax Dispersion 5 and Fine Particle Dispersion 6 were used instead of Pigment-wax Dispersion 1 and Fine Particle Dispersion 1, and that the sample was transferred into a T.K. HOMO MIXER on the way of removal of the solvents, was stirred therein at 13,000 rpm for 30 minutes and thereby yielded a toner having an spindle shape.

PREPARATION EXAMPLE 21

Preparation of Organic Fine Particle Emulsion

In a reactor equipped with a stirring rod and a thermometer were placed 683 parts of water, 11 parts of a sodium salt of sulfuric acid ester of ethylene oxide adduct of methacrylic acid ELEMINOL RS-30 (trade name, available from Sanyo Chemical Industries, Ltd., Japan), 63 parts of styrene, 83 parts of methacrylic acid, 130 parts of butyl acrylate, 12 parts of butyl thioglycolate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium sulfate, was aged at 75° C. for 5 hours and thereby yielded an aqueous dispersion [Fine Particle Dispersion 7] of a vinyl resin (a copolymer of styrene-methacrylic acid-butyl acrylate-sodium salt of sulfuric acid ester of ethylene oxide adduct of methacrylic acid). Fine Particle Dispersion 7 had a volume-average particle diameter of 130 nm when measured with a laser diffraction-scattering size distribution analyzer LA-920. Part of Fine Particle Dispersion 7 was dried to isolate the resin component. The resin component had a Tg of 30° C. and a weight-average molecular weight of $5\times10^3$.

COMPARETIVE EXAMPLE 4

Base toner-particle 11 was prepared by the procedure of Example 1, except that Pigment-wax Dispersion 5 and Fine Particle Dispersion 7 were used instead of Pigment-wax Dispersion 1 and Fine Particle Dispersion 1, respectively.

Next, 100 parts of Base toner-particle 11 and 0.7 part of hydrophobic silica were mixed in a Henschel Mixer and thereby yielded Toner 11.

COMPARETIVE EXAMPLE 5

| | |
|---|---|
| Binder Resin 1 (polyester resin; THF insoluble content 0% by weight) | 80 parts |
| Binder Resin 2 (urea-modified polyester resin; THF insoluble content 10% by weight) | 20 parts |
| Wax (carnauba wax) | 5 parts |
| Charge Control Agent (zinc complex of salicylic acid derivative, Bontron E-84, from Orient Chemical Industries, Ltd.) | 2 parts |
| Colorant (carbon black Regal 1400R from Cabot) | 10 parts |

The above materials were sufficiently mixed in a blender, and the mixture was melted and kneaded with a two-roll mill heated at 110° C. to 120° C. The kneaded product was left stand to cool, was roughly pulverized with a cutter mill, was further pulverized with a pulverizer of a jet mill breaker disc system, was subjected to air classification by action of a revolving current and thereby yielded toner particles. The toner particles were converted into spherical particles with a surface modifying apparatus NPK Surfusing System (trade name, available from Nippon Pneumatic Mfg. Co., Ltd.).

Next, 100 parts of the toner particles and 0.7 part of hydrophobic silica as an external additive were mixed in a Henschel Mixer and thereby yielded Toner 12.

The volume-average particle diameter, number-average particle diameter, circularity, the ratio (r2/r1) of a minor axis r2 to a major axis r1, the ratio (r3/r2) of a thickness r3 to a minor axis r2, and the dispersion of the wax of the above-prepared toners were determined. The results are shown in Table 1.

Determination Method

Particle Diameter Distribution

Initially, a dispersant, i.e., 0.1 ml to 5 ml of surfactant (preferably alkylbenzene sulfonate) was added to 100 ml to 150 ml of electrolytic solution. The electrolytic solution was approximately 1% aqueous solution of NaCl of extra pure sodium chloride, such as ISOTON-II (trade name, available from Beckman Coulter, Inc.). Next, 2 mg to 20 mg of a test sample was added to the electrolytic solution. The electrolytic solution suspending the test sample was dispersed by an ultrasonic disperser for about 1 minute to 3 minutes. Thereafter, toner particles, or volume and number of toner were measured by the above-mentioned apparatus, i.e., the Coulter Counter TA-II (trade name, available from Beckman Coulter, Inc.) with an aperture of 100 μm, and volume particle distribution and number particle distribution were calculated thereby.

As channels, 13 channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm, were used. Here, the object was particles having a diameter range of 2.00 μm to less than 40.30 μm. Volume-average particle diameter Dv was calculated from the volume particle distribution, number-average particle diameter Dn was calculated from the number particle distribution, and then a ratio Dv/Dn was calculated therefrom.

Circularity

The circularity was determined as the circularity on average by a flow type particle image analyzer FPIA-2000 (the manufacturer: Toa Medical Electronics). Specifically, the measurement was performed by adding 0.1 ml to 0.5 ml of a surfactant such as an alkylbenzene sulfonate as a dispersing agent to 100 ml to 150 ml of water in a vessel from which solid impurities had been previously removed, and then adding approximately 0.1 g to 0.5 g of the test portion. The suspension, in which the test portion was dispersed, was subjected to dispersion treatment for approximately 1 minute to 3 minutes by an ultrasonic disperser, and the shape and distribution of the toner particles were determined by the above apparatus at a dispersion concentration of 3,000 particles per microliter to 10,000 particles per microliter.

Dispersion of Wax

Toner particles were embedded into an epoxy resin and then the epoxy resin was cured. The epoxy resin embedding the toner particles was very finely sliced so as to yield an ultrathin section having a thickness of approximately 100 μm. The toner particles within the ultrathin section were dyed with ruthenium tetroxide. Thereafter, the ultrathin section was observed under a transmission electron microscope (TEM) at a magnification of 10,000 times, and pictures of the toner particles were taken. Twenty pictures (twenty toner particles) were visually evaluated, dispersing conditions of the wax were observed therefrom.

TABLE 1

| | Dv (μm) | Dn (μm) | Dv/Dn | Circularity | r2/r1 | r3/r2 | Amount of wax (% by number)*1 | Dispersion of wax | Amount of wax*2 (% by number) | Wax | External additive | Amount of wax*3 (% by number) |
|---|---|---|---|---|---|---|---|---|---|---|---|---|
| Ex. 1 | 4.5 | 3.5 | 1.29 | 0.98 | 0.95 | 0.91 | 85 | Concentrated in the vicinity of | 75 | carnauba wax | hydrophobic titanium oxide | 70 |
| Ex. 2 | 5.9 | 4.9 | 1.20 | 0.98 | 0.94 | 0.93 | 92 | surface of the toner core | 80 | carnauba wax | hydrophobic titanium oxide | 75 |

TABLE 1-continued

| | Dv (μm) | Dn (μm) | Dv/Dn | Circularity | r2/r1 | r3/r2 | Amount of wax (% by number)*1 | Dispersion of wax | Amount of wax*2 (% by number) | Wax | External additive | Amount of wax*3 (% by number) |
|---|---|---|---|---|---|---|---|---|---|---|---|---|
| Ex. 3 | 6.5 | 6.0 | 1.08 | 0.97 | 0.97 | 0.95 | 90 | | 85 | carnauba wax | hydrophobic titanium oxide | 80 |
| Ex. 4 | 6.1 | 5.3 | 1.15 | 0.96 | 0.93 | 0.92 | 95 | | 85 | carnauba wax | hydrophobic silica | 85 |
| Ex. 5 | 3.8 | 3.2 | 1.19 | 0.97 | 0.92 | 0.93 | 94 | | 90 | rice wax | hydrophobic silica | 80 |
| Ex. 6 | 5.4 | 4.7 | 1.15 | 0.95 | 0.71 | 0.91 | 92 | | 85 | montan wax | hydrophobic titanium oxide | 80 |
| Ex. 7 | 4.0 | 3.4 | 1.18 | 0.93 | 0.65 | 0.85 | 78 | | 90 | ester wax. | hydrophobic silica | 85 |
| Comp. Ex. 1 | 7.2 | 5.9 | 1.22 | 0.97 | 0.94 | 0.94 | 85 | Uniformly dispersed inside the toner | 55 | carnauba wax | hydrophobic titanium oxide | 50 |
| Comp. Ex. 2 | 5.5 | 4.3 | 1.28 | 0.97 | 0.92 | 0.92 | 88 | Uniformly dispersed inside the toner | 60 | carnauba wax | hydrophobic titanium oxide | 55 |
| Comp. Ex. 3 | 6.0 | 5.2 | 1.15 | 0.92 | 0.68 | 0.88 | 77 | Concentrated inside the toner | 70 | carnauba wax | hydrophobic titanium oxide | 60 |
| Comp. Ex. 4 | 3.0 | 2.3 | 1.30 | 0.96 | 0.97 | 0.95 | 66 | Exposed from the toner surface | 80 | carnauba wax | hydrophobic silica | 75 |
| Comp. Ex. 5 | 6.0 | 4.8 | 1.25 | 0.97 | 0.83 | 0.91 | 65 | Exposed from the toner surface | 80 | carnauba wax | hydrophobic silica | 75 |

*1: Amount of wax particles having a dispersed particle diameter of 0.1 to 3 mm.
*2: Amount of wax particles occurring outside of an inner circumference having one half of the radius of a toner particle.
*3: Amount of wax particles (% by number) occurring in a region on an arbitrary cross section having a center of a toner particle thereon, where the region lies between an outer circumference of the arbitrary cross section and an inner circumference having a radius two thirds of a radius of the outer circumference.

A series of developers was prepared by mixing 5 parts of each of the above-prepared toners and 95 parts of a carrier in a blender for 10 minutes. The carrier used herein contained spherical ferrite particles having an average particle diameter of 50 μm as a core coated with a coating material. The carrier had been prepared by dispersing an aminosilane coupling agent and a silicon resin in toluene to yield a dispersion, spraying the dispersion to the core with heating, then firing, and cooling to yield a carrier having a coated resin layer having an average thickness of 0.2 μm.

The lowest fixing temperature, hot offset occurring temperature, and charge amount of the above-prepared developers were determined. The results are shown in Table 2.

Lowest Fixing Temperature

A copying test was carried out on Type-6200 Paper (trade name, available from Ricoh Company Limited) by the modified fixing device of Copier imagio MF-200 (trade name, available from Ricoh Company Limited) as a fixing roller using Teflon (registered trademark) roller as a fixing roller. The lowest fixing temperature (° C.) was defined as a temperature of the fixing roller at which a survival rate of the image density was 70% or more after rubbing the fixed image with a pat.

Hot Offset Occurring Temperature (HOT)

A copying test was performed in the same manner as in the above lowest fixing temperature test, and occurrence of hot offset to the fixed image was visually observed. The hot offset occurring temperature was defined as a temperature of the fixing roller at which hot offset occurred.

Charge Amount

The charge amount of the developer was determined before use (initial charge amount) and after printing 100,000 copies in a printer Preter 650 (trade name, available from Ricoh Company Limited) by the blow off method using an electrometer.

TABLE 2

| | Lowest fixing temperature ° C. | Hot offset occurring temperature ° C. | Charge amount of developer: Before printing -μc/g | Charge amount of developer: After 100000-copy printing -μc/g | evaluation |
|---|---|---|---|---|---|
| Ex. 1 | 120 | 220 or more | 25 | 23 | Pass |
| Ex. 2 | 120 | 220 | 22 | 24 | Pass |
| Ex. 3 | 115 | 220 | 21 | 25 | Pass |
| Ex. 4 | 120 | 220 | 29 | 30 | Pass |
| Ex. 5 | 110 | 220 | 28 | 27 | Pass |
| Ex. 6 | 120 | 220 | 26 | 25 | Pass |
| Ex. 7 | 125 | 220 | 28 | 27 | Pass |
| Comp. Ex. 1 | 140 | 220 | 18 | 16 | Fail |
| Comp. Ex. 2 | 140 | 220 | 15 | 14 | Fail |
| Comp. Ex. 3 | 145 | 185 | 14 | 12 | Fail |
| Comp. Ex. 4 | 155 | 220 | 18 | 9 | Fail |
| Comp. Ex. 5 | 145 | 220 | 16 | 10 | Fail |

The dry toner of the present invention can be used in a developer for developing latent electrostatic images, for example, in electrophotography, electrostatic recording or electrostatic printing and has a wide fixing region in a fixing apparatus of low energy consumption and excellent storability. The dry toner can be stably charged and can stably yield images with high resolution and high precision.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A dry toner comprising:

a base toner-particle, a charge control agent on the surface of the base toner-particle; and an external additive on the surface of the base toner-particle, the base toner-particle comprising a toner core and organic fine particles on the surface of the toner core, the toner core comprising a toner binder, a colorant, and wax, wherein the wax is concentrated in the vicinity of the surface of the toner core.

2. A dry toner according to claim 1, wherein the vicinity of the surface of the toner core is a region on an arbitrary cross section of the toner core, having a center of the toner core thereon, where the region lies between an outer circumference of the arbitrary cross section and an inner circumference having a radius two thirds of a radius of the outer circumference.

3. A dry toner according to claim 1, wherein the vicinity of the surface of the toner core is a region on an arbitrary cross section of the toner core, having a center of the toner core thereon, where the region lies between an outer circumference of the arbitrary cross section and an inner circumference having a radius one half of a radius of the outer circumference, and wherein the wax in a shape of dispersed particles occurring in the region occupies 80% by number or more of the total wax.

4. A dry toner according to claim 1, wherein the vicinity of the surface of the toner core is a region on an arbitrary cross section of the toner core, having a center of the toner core thereon, where the region lies between an outer circumference of the arbitrary cross section and an inner circumference having a radius two thirds of a radius of the outer circumference, and wherein the wax in a shape of dispersed particles occurring in the region occupies 70% by number or more of the total wax.

5. A dry toner according to claim 1, wherein the wax is not exposed from the surface of the base toner-particle.

6. A dry toner according to claim 1, wherein the wax in a shape of dispersed particles having a particle diameter of 0.1 μm to 3 μm occupies 70% by number or more of the total wax.

7. A dry toner according to claim 1, wherein the wax is at least one selected from the group consisting of free fatty acid eliminated carnauba wax, rice wax, montan wax, and ester wax.

8. A dry toner according to claim 1, wherein the toner binder comprises at least one modified polyester (i).

9. A dry toner according to claim 8, wherein the toner binder has a toner composition containing the modified polyester (i) as a raw material thereof and the toner composition containing a modified polyester (i) is at least one of dissolved and dispersed in an organic solvent and is then dispersed into an aqueous medium so as to form the toner binder.

10. A dry toner according to claim 8, wherein the modified polyester (i) is formed while a toner composition containing a polyester prepolymer is dissolved or dispersed in an organic solvent and is then dispersed into an aqueous medium.

11. A dry toner according to claim 8, wherein the toner binder further comprises an unmodified polyester (ii) in addition to the modified polyester (i), and wherein the weight ratio of the modified polyester (i) to the unmodified polyester (ii) is from 5:95 to 80:20.

12. A dry toner according to claim 8, wherein the toner binder has a peak molecular weight of 1,000 to 10,000.

13. A dry toner according to claim 8, wherein the toner binder has a glass transition point Tg of 40° C. to 70° C.

14. A dry toner according to claim 1, wherein the toner has a volume-average particle diameter Dv of 3.0 μm to 8.0 μm and a ratio Dv/Dn of the volume-average particle diameter Dv to a number-average particle diameter Dn of 1.00 to 1.20.

15. A dry toner according to claim 1, wherein the toner has an average circularity of 0.93 to 1.00.

16. A dry toner according to claim 1, wherein the toner particle has a spindle shape.

17. A dry toner according to claim 16, wherein the toner particle has an spindle shape having a major axis r1, a minor axis r2 and a thickness r3, wherein the ratio (r2/r1) of the minor axis r2 to the major axis r1 is 0.5 to 0.8, and the ratio (r3/r2) of the thickness r3 to the minor axis r 2 is 0.7 to 1.0.

18. A dry toner according to claim 1, wherein the external additive comprises at least one of hydrophobic silica and hydrophobic titanium oxide.

19. An image forming process, comprising:

charging a photoconductor;

irradiating the photoconductor with radiation to form a latent electrostatic image thereon;

developing the latent electrostatic image using a toner to form a toner image;

transferring the toner image onto a recording medium; and fixing the transferred unfixed toner image on the recording medium;

the fixing being a heat fixing comprising passing the recording medium bearing the unfixed toner image between a film and a pressurizing member of a fixing device, the fixing device comprising:

a heating member having a heating element, the film in contact with the heating member, and the pressurizing member in contact with the heating member with the interposition of the film, wherein the toner is a dry toner comprising:

a base toner-particle, a charge control agent on the surface of the base toner-particle, and an external additive also over the base toner-particle, the base toner-particle comprising a toner core and organic fine particles on the surface of the toner core, the toner core comprising at least a toner binder, a colorant, and a wax, wherein the wax is concentrated more in the vicinity of the surface of the toner core than in any other rejoins of the toner core.

20. An image forming process according to claim 19, wherein the photoconductor is an amorphous silicon photoconductor.

21. An image forming process according to claim 19, further comprising applying an alternating field in the step of developing the toner image.

22. An image forming process according to claim 19, wherein the step of charging the photoconductor comprises bringing the photoconductor in contact with an electrostatic charger, and applying a voltage to the electrostatic charger.

23. A process cartridge, comprising:

a photoconductor; and a developing device, wherein the process cartridge is detachable from an image forming apparatus, wherein the developing device contains a dry toner, the dry toner comprising:

a base toner-particle, a charge control agent on the surface of the base toner-particle, and an external additive also over the base toner-particle, the base toner-particle comprising a toner core and organic fine particles on the surface of the toner core, the toner core comprising at least a toner binder, organic fine particles, a colorant, and a wax, wherein the wax is concentrated more in the vicinity of the surface of the toner core than in any other regions of the toner core.

24. An image forming apparatus comprising:

a photoconductor;

a charger for charging the photoconductor;

an irradiator for irradiating the photoconductor with radiation to form a latent electrostatic image thereon;

a developing unit for developing the latent electrostatic image with a toner to form a toner image;

a transferring unit for transferring the toner image onto a recording medium; and a fixer for fixing the transferred toner image on the recording member, wherein the toner is a dry toner comprising:

a base toner-particle, a charge control agent, and an external additive on the surface of the base toner-particle, the base toner-particle comprising a toner core and organic fine particles on the surface of the toner core, the toner core comprising at least a toner binder, a colorant, and a wax, wherein the wax is concentrated in the vicinity of the surface of the toner core.

25. An image forming apparatus according to claim 24, wherein the fixer is a fixing device comprising:

a heating member having a heating element, a film in contact with the heating member, and a pressurizing member in contact with the heating member with the interposition of the film, and wherein the fixing device is so configured as to allow a recording medium bearing an unfixed image to pass between the film and the pressurizing member.

* * * * *